US010982384B2

(12) United States Patent
Mor et al.

(10) Patent No.: US 10,982,384 B2
(45) Date of Patent: Apr. 20, 2021

(54) SYSTEM, MACHINE AND METHOD FOR TREATING THREADS OR PARTS THEREOF

(71) Applicant: TWINE SOLUTIONS LTD., Petah Tikva (IL)

(72) Inventors: Ilanit Mor, Kiryat Ono (IL); Yoram Zilberberg, Tel Aviv (IL); Alon Navon, Even Yehuda (IL); Gilad Gotesman, Netanya (IL); Alon Moshe, Petach Tiqva (IL)

(73) Assignee: TWINE SOLUTIONS LTD., Petah Tikva (IL)

( * ) Notice: Subject to any disclaimer, the term of this patent is extended or adjusted under 35 U.S.C. 154(b) by 0 days.

(21) Appl. No.: 16/302,474

(22) PCT Filed: May 23, 2017

(86) PCT No.: PCT/IL2017/050573

§ 371 (c)(1),
(2) Date: Nov. 16, 2018

(87) PCT Pub. No.: WO2017/203524

PCT Pub. Date: Nov. 30, 2017

(65) Prior Publication Data

US 2019/0301083 A1 Oct. 3, 2019

Related U.S. Application Data

(60) Provisional application No. 62/340,682, filed on May 24, 2016, provisional application No. 62/397,625, filed on Sep. 21, 2016.

(51) Int. Cl.
*D06P 1/00* (2006.01)
*D06B 1/08* (2006.01)
(Continued)

(52) U.S. Cl.
CPC ..... *D06P 1/0032* (2013.01); *B05C 1/04* (2013.01); *B05C 5/001* (2013.01); *B05C 5/02* (2013.01);
(Continued)

(58) Field of Classification Search
None
See application file for complete search history.

(56) References Cited

U.S. PATENT DOCUMENTS 1,922,511 A 8/1933 Van Nes
2,373,470 A 4/1945 Hanke
(Continued)

FOREIGN PATENT DOCUMENTS

CN 202881670 U 4/2013
DE 102008039735 A 3/2010
(Continued)

*Primary Examiner* — Jethro M. Pence
(74) *Attorney, Agent, or Firm* — Volpe Koenig

(57) ABSTRACT

A system, a method and a machine for treating threads or parts thereof, the machine having one or more cartridges each configured for containing thread treatment-material therein; one or more injectors, each injector being configured for applying treatment-material from its respective cartridge over a passing portion of the thread; drive means for operating the one or more injectors; and a communication and control unit for receiving treatment plan data indicative of at least one machine readable treatment related parameter associated with at least one treatment effect for each thread portion to be treated for controlling the treatment effect of each passing thread portion, according to the received treatment plan data. A designated application of the system may be used having a unique user interface allowing creating treatment plans.

25 Claims, 16 Drawing Sheets

(51) Int. Cl.

| | |
|---|---|
| ***D06B 3/04*** | (2006.01) |
| ***D06P 5/20*** | (2006.01) |
| ***B05C 5/02*** | (2006.01) |
| ***D06P 5/30*** | (2006.01) |
| ***B05C 1/04*** | (2006.01) |
| ***B05C 5/00*** | (2006.01) |

(52) U.S. Cl.

CPC ..... *B05C 5/0245* (2013.01); *B05C 5/0291* (2013.01); *D06B 1/08* (2013.01); *D06B 3/045* (2013.01); *D06P 5/2005* (2013.01); *D06P 5/2033* (2013.01); *D06P 5/2077* (2013.01); *D06P 5/30* (2013.01)

(56) References Cited

U.S. PATENT DOCUMENTS

| | | | | |
|---|---|---|---|---|
| 3,570,275 | A | | 3/1971 | Weber et al. |
| 3,599,451 | A | | 8/1971 | Getz et al. |
| 3,808,618 | A | | 5/1974 | Arimoto et al. |
| 3,916,651 | A | * | 11/1975 | Carruthers ..... D02G 1/205 68/5 E |
| 3,952,552 | A | | 4/1976 | Rozner |
| 3,955,254 | A | | 5/1976 | Delarue et al. |
| 3,978,695 | A | | 7/1976 | Rene et al. |
| 4,614,969 | A | * | 9/1986 | Gerundt ..... D04H 18/02 18/2 |
| 5,862,649 | A | | 1/1999 | Benz |
| 5,868,010 | A | | 2/1999 | Threlkeld |
| 6,030,076 | A | | 2/2000 | Hisashi et al. |
| 6,189,989 | B1 | * | 2/2001 | Hirabayashi ..... B41J 3/407 347/106 |
| 8,833,283 | B2 | | 9/2014 | Rinaldo et al. |
| 2003/0135931 | A1 | | 7/2003 | Henry |
| 2011/0016842 | A1 | | 1/2011 | Kagi et al. |
| 2014/0082859 | A1 | | 3/2014 | Bryan et al. |

FOREIGN PATENT DOCUMENTS

| | | | |
|---|---|---|---|
| GB | 1120787 | A | 7/1968 |
| GB | 2324541 | A | 10/1998 |
| WO | 20160204687 | A1 | 12/2016 |

* cited by examiner

Heating component
133
131
130

90
Sealing
131

130
133
131
132
130
Head body
12

132
Ink channel

SYSTEM, MACHINE AND METHOD FOR TREATING THREADS OR PARTS THEREOF

This application is a 35 U.S.C. § 371 national phase application of PCT/IL2017/050573, which was filed May 23, 2017, and claims the benefit of U.S. provisional patent application 62/340,682, filed May 24, 2016, and U.S. provisional patent application 62/397,625, filed Sep. 21, 2016, all of which are incorporated herein by reference as if fully set forth.

FIELD OF THE INVENTION

The present invention relates to devices, systems and methods for treating threads by using one or more injectors and cartridges containing thread treatment-materials.

BACKGROUND OF THE INVENTION

Treating threads such as for dyeing or coating thereof is typically done by soaking an entire thread in the treatment-material and optionally curing or drying it for allowing the material to set in and/or over the thread.

Many parameters and conditions influence a final treatment quality such as color or color tone (used herein interchangeably) of a thread used, e.g., for embroidery, quilting, weaving or sewing. These parameters include, e.g., the material from which the thread is made and the material of the dyes mixture used for dyeing thereof, the exposure time of the thread to the dye, absorption characteristics of the thread depending, e.g. on thickness and material. In order to achieve the exact desired color tone for each thread roll or for dyeing the same thread with multiple colors where each thread portion is of a different color, the thread dyeing machine has to be configured such as to allow releasing the exact quantity of each available dye thereof for the dyes mixture to fit the desired color tone while it dyes the thread.

Off-the-shelf available color tones of threads are limited, thus requiring a person engaged in sewing, embroidery, quilting etc., to use only colors that can be bought nearby or through the internet.

Often, a person wishes to have a thread of a color tone of some fabric they need to fix or use or an object that he/she cannot get the exact tone of color from the off-the-shelf available rolls of threads, and cannot compare the actual color to a virtually displayed one from a website presenting the available thread rolls of a company.

U.S. Pat. No. 3,808,618 teaches a method of continuously dyeing a yarn, which comprises heating a running yarn to a temperature above the boiling point of a solvent in a dye and contacting said heated yarn with one or more dye applicators having a dye discharge aperture while discharging a dye through said aperture and onto said yarn.

U.S. Pat. No. 3,952,552 teaches a mechanism for dyeing yarns as they are fed from their cones into a knitting machine. Each yarn passes through a container with a liquid dye of a specific color. Although a quick-drying dye is used, to insure that each yarn is completely dry prior to its reaching a knitting needle, a jet of air is also used as the yarn exits the dye container.

U.S. Pat. Nos. 2,373,470, 1,922,511 and 3,570,275, teach methods and machines for crimping yarn by dipping thereof in a dyeing bath or by spraying or injecting dye thereover.

U.S. Pat. No. 3,955,254 teaches methods and apparatus for treating yarn with a fluid material. The apparatus includes a chamber through which the yarn is advanced and an injection nozzle for impinging fluid on the yarn as it advances through the chamber. U.S. Pat. No. 3,955,254 describes the possibility of applying fluid treatment-material according to a selected pattern, or to impinge treatment-materials having different characteristics, such as dyes of different colors.

WO 2016/204687 describes devices and methods for in-line thread treatment for use with a consuming device, e.g. an embroidery- or sewing-machine, the devices comprise (i) a thread feeding unit followed by; (ii) a treatment unit for dispensing material onto the passing thread; and (iii) a fixation unit for fixing the material prior to thread passage to the consuming device.

WO 2016/204687 describes thread treatment device and method for controlling fixation of a treatment-material applied to a thread during a continuous in-line thread consuming process. The device comprises mainly: (i) a treatment unit; (ii) a fixation unit; and (iii) a control unit.

US 2011/0016842 discloses a method for manufacturing dyed threads, while both dyeing and improving the thread properties.

US 2003/135931 describes thread treatment devices, integrated systems and methods of using same for treating a thread and use thereof.

U.S. Pat. No. 8,833,283 relates to an inkjet printhead which can be integrated with, e.g., a sewing- or embroidering-machine, for dyeing a thread as it passes through.

U.S. Pat. No. 6,189,989 discloses an integrated system for treating a thread and using same, the system comprises: (i) a printing means for dyeing a thread; (ii) a scanning means for moving said printing means and said thread relative to one another; (iii) a thread applicator configured for using the treated thread; and (iv) a control unit.

U.S. Pat. Nos. 5,868,010 and 5,802,649 describe a device and method for dyeing a thread, said device comprises: (i) a dye applicator; (ii) a heating element for drying the thread; and (iii) a winding means.

GB 2324541 describes a combination of an embroidery machine with a yam dyeing apparatus for generating a multi-colored yarn. The combination comprises (i) a dyeing head designed to dye the thread according to the embroidery speed; (ii) a thread velocity monitor; and (iii) a central control unit.

GB 1120787 describes a method for dyeing threads, comprising: (i) applying a solution of a surface modifier on the thread; (ii) heating said thread to remove solvent; (iii) dyeing the thread with a dye solution; and (iv) re-heating the thread to fix the dye.

SUMMARY OF THE INVENTION

The present invention provides a thread treatment machine for treating a thread or portions thereof, said thread treatment machine comprising: (a) at least one cartridge configured for containing thread treatment-material therein; (b) at least one treatment-material delivery unit/system, each connectable to one of said at least one cartridge, and configured for delivering/applying said treatment-material from its respective cartridge over a passing portion of a thread; (c) optionally, a microfluidic mixer in which said treatment-material(s) mix prior to their delivery to the passing portion of the thread; (d) a treatment head with a guiding conduit configured for guiding the thread and applying said treatment-material(s) thereon as it passes through via dedicated orifices (e.g. nozzles or holes); (e) a treatment-material fixation/drying unit/system configured for fixating said treatment-material onto said thread; (f) at least one engine for pulling said thread through said thread treatment machine; (g) at least one thread-tension creating and/or controlling unit; (h) a communication and control unit for receiving treatment plan data indicative of at least one machine readable treatment related parameters (TRP) associated with at least one treatment effect for each thread portion to be treated, at least for controlling quantities of treatment-material outputted by each treatment-material delivery unit/system at each given timeframe for controlling the treatment effect of each passing thread portion, according to the received treatment plan data; and (i) at least one treatment-material fixation unit (interchangeably referred to herein as thread post-treatment unit).

The present invention further provides a system for treating threads or portions thereof, said system comprising: (a) a thread treatment machine of the invention; and (b) an application module operable via a user end device having a user interface, said application module being configured for: (i) inputting treatment related plan data associated with at least one desired treatment effect for a thread portion treatment, (ii) setting a machine readable treatment plan comprising treatment related parameters (TRP) data based thereon, and (iii) transmitting said treatment plan data to said thread treatment machine over at least one communication link.

The present invention further provides a method for treating threads comprising the steps of: (a) providing a thread treatment machine according to the invention being configured for injecting a treatment-material over a passing thread portion for treating thereof, and controllable by said communication and control unit; (b) providing an application module, operable via a users' end device having a user interface, said application module being configured for inputting treatment plan data associated with desired treatment effect(s), determining treatment related parameters (TRP) for setting a machine readable treatment plan data based thereon, and transmitting said treatment plan data to said thread treatment machine; (c) receiving the treatment plan data from the users' end device; (d) directing a thread through a guided path over the treatment head of said thread treatment machine, optionally by using a guiding means; and (e) applying at least one treatment-material from said cartridge(s) over at least one thread portion of the guided thread according to the received treatment plan data, thereby obtaining a treated thread.

BRIEF DESCRIPTION OF THE DRAWINGS

FIG. 4A is a front view; FIG. 4B is a 3-D view; and FIG. 4C is an enlargement of the conduit holding the thread.

DETAILED DESCRIPTION OF SOME EMBODIMENTS OF THE INVENTION

Figure 1:
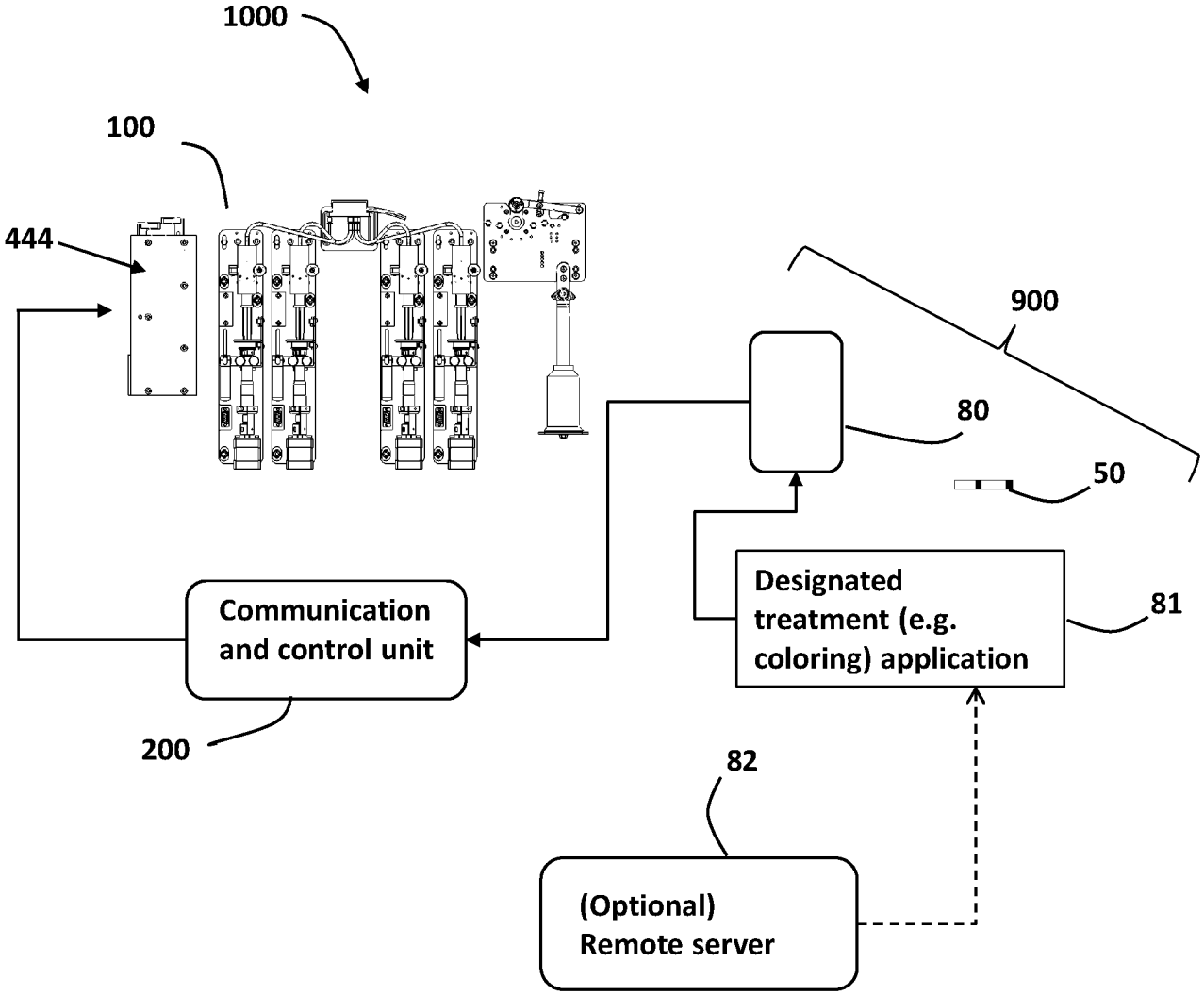
FIG. 1 shows a block diagram of a system for color-treating threads or portions thereof by acquiring and receiving coloring plan data from a designated coloring application operable via users end devices, according to some embodiments of the present invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention provides machines, devices, systems and methods for treating threads or portions thereof according to input data sent from a communication and computer means such as from users' end devices e.g. personal mobile devices such as smartphones, PC computers, laptops, tablet devices and the like. The system includes a novel thread treatment machine that has or connects to means for communicating with such end devices and to operate one or more injectors thereof connected or embedded in treatment-material cartridges according to the received input data. The treatment-material(s) may be any kind of material that can be used for dyeing, coating or changing properties of the thread such as dye materials, coating materials for coating the threads or portions thereof with protective materials, treatment-materials designed to enhance properties of the thread such as for strengthening the thread, pharmaceutical, cosmeceutical and/or nutraceutical materials for adding cosmetic or medical properties to the threads such as for adding pharmaceutical various materials to portions of surgical threads according to medical requirements associated with each particular patient or surgery type and the like.

Accordingly, the present invention provides a thread treatment machine for treating a thread or portions thereof, wherein the thread treatment machine comprises: at least one cartridge configured for containing thread treatment-material therein; at least one injector each connectable to one of the at least one cartridge, each injector being configured for applying treatment-material from its respective cartridge over a passing portion of a thread; at least one drive means for operating the at least one injector; and a communication and control unit, e.g. for communicating with remote end devices of users, for receiving treatment plan data indicative of at least one machine readable treatment related parameter associated with at least one treatment effect for each thread portion to be treated at least for controlling quantities of treatment-material outputted by each injector at each given timeframe for controlling the treatment effect of each passing thread portion, according to the received treatment plan data.

In specific embodiments, each injector comprises a syringe having a syringe body and a needle.

In other embodiments, the present invention provides a thread treatment machine for treating a thread or portions thereof, said thread treatment machine comprising: (a) at least one cartridge configured for containing thread treatment-material therein; (b) at least one treatment-material delivery unit/system 700, each connectable to one of said at least one cartridge, and configured for delivering/applying said treatment-material from its respective cartridge over a passing portion of a thread; (c) optionally, a microfluidic mixer in which said treatment-material(s) mix prior to their delivery to the passing portion of the thread; (d) a treatment head with a guiding conduit configured for guiding the thread and applying said treatment-material(s) thereon as it passes through via dedicated orifices (e.g. nozzles or holes); (e) a treatment-material fixation/drying unit/system configured for fixating said treatment-material onto said thread; (f) at least one engine for pulling said thread through said thread treatment machine; (g) at least one thread-tension creating and/or controlling unit; (h) a communication and control unit for receiving treatment plan data indicative of at least one machine readable treatment related parameters (TRP) associated with at least one treatment effect for each thread portion to be treated, at least for controlling quantities of treatment-material outputted by each treatment-material delivery unit/system 700 at each given timeframe for controlling the treatment effect of each passing thread portion, according to the received treatment plan data. Examples of such parameters are thread type, treatment-material parameters, desired resulting thread parameters, color parameters, thread rigidity/flexibility, etc.

Optionally, said communication and control unit receives said data from a users' end devices, e.g. a remote users' end device; and (i) at least one treatment-material fixation unit (interchangeably referred to herein as thread post-treatment unit 444). Examples of such remote users' end devices are mobile phones, computers, tablet devices, etc.

In certain embodiments, the communication and control unit may be embedded within the thread treatment machine or alternatively connected thereto such as to allow it to control the treatment and guiding of the thread. The communication and control unit may be configured for communication via one or more communication technologies and links such as through wireless communication (e.g. radio frequency (RF) based communication such as WiFi, Bluetooth, etc.) and/or via cable communication links using one or more communication protocols and networks such as the cellular network, the internet, etc.

The term "thread" as used herein refers to any yarn, filament or film like strap or string known in the art such as threads used for weaving, sewing, quilting or embroidery threads or strings, textile fibers, wires (e.g. electric wires or communication cabling wires), ropes, surgery threads, three-dimensional (3D) printers filaments, etc. The thread may have a single yarn or interwoven multiple yarns of different constituents such as polyester, rayon, cotton or others.

In certain embodiments, the thread treatment machine of the invention comprises one, two, three, four, five or more cartridges, containing the same or different thread treatment-materials therein.

In certain embodiments of the thread treatment machine of the invention, each treatment-material delivery unit/system 700 comprises an injector and drive means, or a peristaltic pump, pressurizing pump etc., or any other suitable mechanism. In specific embodiments, said drive means comprises a motor for operating injection of said injector, and an actuator displaceable by said motor, said actuator being configured for displacing a piston member of said injector for injecting treatment-material therefrom. In yet other specific embodiments, said actuator comprises a micrometer head and a pusher, said micrometer head being laterally displaceable by said motor for pushing said pusher which engages piston of said injector. In specific embodiments, the at least one drive means comprises at least one drive motor configured for pushing and/or pulling the thread for directing thereof and at least one motor for operating injection of the at least one injector and at least one actuator displaceable by the at least one motor, the actuator being configured for displacing a piston member of the injector for injecting treatment-material therefrom. The actuator optionally comprises a micrometer head and a pusher, the micrometer head being laterally displaceable by the at least one motor for pushing the pusher which engages piston of the injector.

In specific embodiments, two or more cartridges are fluidly connected to a premix cassette/chamber, in which the treatment-materials are premixed prior to their applying onto the thread, and each injector is configured for applying said premixed treatment-material from said premix cassette/chamber over a passing portion of a thread.

Accordingly, in certain embodiments, the thread treatment machine of the invention comprises a microfluidic mixer for mixing all- or part-of the treatment-materials prior to their delivery to the passing portion of a thread. In a specific embodiment, the thread treatment machine comprises two parallel routes for each treatment-material: one leading directly from the respective cartridge to the treatment head; and the other passing through said microfluidic mixer, wherein the thread treatment machine further comprises a valve designed to direct each treatment-material to the appropriate route according to the received treatment plan data.

According to some embodiments, the treatment-materials used by the thread treatment machine of the invention comprise at least one treatment-material type from the following list: dye material, coating material, dye effect material, conductive materials, magnetic material, biological active material, and chemical treatment-material.

The treatment-materials used by the thread treatment machine of the invention can be any liquid or gel type materials, e.g. of liquid of viscosity nature adapted to the thread type and thickness, as well as to the treatment process and system. For example, in case of a dye treatment, the treatment-materials are dyes such as ink, or fast-dry inks.

Accordingly, in certain embodiments, dye treatment-materials that can be used by the thread treatment machine of the invention include dye effect materials such as material for producing glittering or glowing effects or dotted effect, etc. Additionally, material types can be used instead of dye materials or in addition thereto that may be non-visible but with constituents that affect the thread characteristics such as tensile strength or conductivity. Therefore, the term dye used herein as a noun refers to any material for coloring such as paint or ink and/or material that can be used for creating a visual and/or functional effect.

In certain embodiments, said treatment-material delivery unit/system 700 is an injector that comprises an injector body and a nozzle with an orifice for injecting the treatment-material therefrom and each injector is configured such that its nozzle orifice is positioned in an upright orientation such as to apply the treatment-material therefrom upwardly, substantially opposite to gravitation. Alternatively, each injector is configured such that its nozzle orifice is positioned in a downwardly orientation such as to apply the treatment-material therefrom according to the direction of gravitation. In yet another embodiment, the thread treatment machine comprises injector, wherein some of the nozzle orifices are positioned in an upright orientation, and the others in a downwardly orientation.

In specific embodiments, the rim of the nozzle of each injector is nearly flush for optimal engagement with the thread portion passing thereover or thereby, and/or for better flow of the ink droplet. In addition, in certain embodiments, the surface of the conduit is very smooth for better flow of the ink droplet.

In yet an alternative embodiment, the thread treatment machine of the invention comprises injectors, each connectable to a cartridge containing the same of different thread treatment-material such that the desired treatment effect as set at the treatment plan, is achieved by controlling the quantity of treatment-material injected from each injector over that passing by thread portion allowing the passing thread portion to absorb the different treatment-materials therein from the different injectors. The injectors may be spaced from one another in an aligned manner over a thread path such as to allow absorption time between one material-portion injected from one injector to another material portion injected from the next injector.

The distance between the injectors or orifices at the treatment head is determined such as to enable better mixing of the treatment-materials on the passing portion of the thread, with minimum cross contamination thereof. For instance, the injectors or orifices are positioned as close as possible to each other to obtain better color mixing, while enabling sufficient distance to prevent color cross contamination in the nozzles. In a specific embodiment, the spacing between the nozzles is minimal so that the treatment-material, e.g. dye, does not dry before the next treatment-material is applied, in order to enable efficient mixing.

Accordingly, the distance between two adjacent injectors or orifices is of from about 1, 2, 3, 4, 5, 6, 7, 8, 9, 10 mm to about 100, 90, 80, 70, 60, 50, 40, 30, 20, 10 mm. In specific embodiments, the treatment head is configured such that the distance between two adjacent injectors or orifices is adjustable according to the received treatment plan data.

The dimension of each nozzle/orifice may be used to determine the size of the droplet being applied onto the passing thread, and thereby affect the frequency of the "treatment-material spots" on a thread (i.e. the "zebra" effect). Notably, at low injection rates, this is a crucial parameter affecting thread absorbance/pulling pace and treatment efficiency. Accordingly, in some embodiments the dimensions of the nozzle of each injector and size of orifice thereof is designed such as to prevent or at least reduce effects of drawing or pulling excess treatment-material by the thread depending on natural saturation of the thread and capillary action of the nozzle.

According to some embodiments, the thread treatment machine further comprises a guiding set configured, e.g., for directing the thread over the treatment head and the orifices therein. For example, the guiding set comprises at least one thread roll holder and at least two directing rollers. The guiding set optionally further comprises a guiding member with a guiding conduit for directing the thread to pass therein, the conduit comprising openings located bellow, next-to or above the thread for allowing the treatment-material to be injected therefrom and onto the thread passing in the conduit. The guiding set may additionally comprise a mechanism for adapting the width 133 of the conduit of the guiding member according to the thread type and thickness being used.

In certain embodiments, the thread treatment machine of the invention further comprises an integration mechanism configured for integrating thereof with one or more of the following additional machines: a sewing machine, an embroidery machine, a knitting machine, a quilting machine or a weaving machine. In specific embodiments, the communication and control unit in these embodiments may also be configured for coordinating pulling and directing of the thread for coordinating the pace of the pulling and guiding of the thread over the orifices at the treatment head and the operation of the additional machine being used. In certain embodiments, once the thread treatment machine of the invention has been integrated/interfaced with such an additional machine, it further allows directing the treated thread into said additional machine for automatically usage of the dyed thread for sewing, embroidery, etc., by coordinating the guiding of the thread through both machines and optionally compensating for tension deviations/irregularity of both machines—first for dyeing and then for using the dyed thread for sewing, quilting, embroidering, etc.

In certain embodiments, the thread treatment machine of the invention further comprises one, two, three, four or more thread-tension creating units for keeping the tension of the thread at a desired tension according to the received treatment plan data and/or according to the requirements of an integrated thread application machine that was integrated together with the thread treatment machine of the invention. In specific embodiments, said thread-tension creating unit is located at the beginning- or end of the thread treatment machine, or anywhere in between, or any combination thereof, e.g. at the beginning, in the middle and at the end.

According to some embodiments, the thread treatment machine of the invention further comprises at least one pretreatment unit/means for pretreatment of the thread, such as but not limited to, at least one of: steaming means, heating means, solvent, chemical pre-treatment, and corona/plasma treatment. In specific embodiments, the treatment-material/formulation itself comprises the pretreatment within it, e.g. a dye formulation with a pretreatment composition/formulation as part thereof.

Additionally or alternatively, the thread treatment machine of the invention further comprises post-treatment units/devices/means 444 such as, but not limited to, at least one of: UV based radiating means, heating means, drying means, pressure means, and any other curing means. In specific embodiments, the curing includes diffusion of the treatment-material, e.g. dye, into the fibers and drying/evaporating of the solvent. In specific embodiments, the curing includes curing or drying of a coating.

In addition, in specific embodiments, the thread treatment machine of the invention further comprises a heating unit for adjusting the temperature of the treatment-material prior to its application onto the thread, to thereby facilitate better treatment of the thread, reduce drying time, etc. In specific embodiments, said heating unit is located within the treatment head, e.g. to heat the treatment material just prior to its application onto the passing thread.

According to some embodiments, each of the at least one cartridge is integrated with a respective injector such that the cartridge head comprises an opening enabling injecting the treatment-material therefrom. In a specific embodiment, the cartridge head has a groove thereover for receiving a passing by thread portion therein.

According to some embodiments, the at least one communication and control unit is further adapted to control timing of applying of the treatment-material from each injector/cartridge according to the desired treatment and treatment plan data, e.g. according to: a desired color tone, for the respective portion passing through; the thread characteristics; the moving pace of the thread portion; and the spacing between the orifices/nozzles.

In certain embodiments of the thread treatment machine of the invention, said orifices within said treatment head are positioned below the thread as it passes through, thereby allowing upwardly delivery of the treatment-material(s), substantially opposite to gravitation. In alternative embodiments of the thread treatment machine of the invention, said orifices within said treatment head are positioned above the thread as it passes through, thereby allowing downwardly delivery of the treatment-material according to gravitation, optionally without creating a direct contact between said orifices and said thread.

In certain embodiments of the thread treatment machine of the invention, said orifices are spaced from one another in an aligned manner over a thread path such as to allow absorption time between one portion of treatment-material which is injected to the same thread portion to the next. In specific embodiments, two adjacent orifices are very close to one another, e.g. from 1 mm to 5 mm, to allow better mixing of the treatment materials before one material is dried and prevent mixing with the next material. In certain embodiments, the distance between adjacent orifices is of from about 1 to about 100 mm. In certain embodiments, the distance between adjacent orifices is adjustable—either by physical adjustment of the treatment head thereby altering the distance between the orifices, or by closing and opening orifices thereby adjusting the distance be creating a series of active/inactive orifices.

In other embodiments of the thread treatment machine of the invention, the dimensions of the orifices are designed such as to prevent or at least reduce effects of drawing or pulling excess treatment-material by the thread, depending on natural saturation of the thread and capillary action of the orifice. In specific embodiments, the dimensions of each orifice are adjustable, optionally independent from one another.

In certain embodiments of the thread treatment machine of the invention, one of said at least one cartridge and one of said at least one treatment-material delivery unit/system 700 that is associated therewith, constitute a single unit, which is optionally replaceable, wherein said single unit further comprises an injector body and a nozzle/tube associated with an orifice/hole at the treatment head or with a microfluidic mixer. In specific embodiments, the machine comprises 1, 2, 3, 4, 5, 6, or more such units, each comprising the same or different treatment material. In yet other specific embodiments, said units are interconnected via a microfluidic chamber in which the various treatment materials undergo mixing prior to their application onto the passing thread.

In certain embodiments of the thread treatment machine of the invention, said treatment related parameters TRP comprise overlapping data defining properties of overlap areas between two adjacent thread portions treated differently, wherein said overlapping data comprises at least one of: thread pretreatment related parameters and injection controlling parameters.

In certain embodiments of the thread treatment machine of the invention, the treatment-material being used is: dye material, coating material, dye effect material, conductive materials, magnetic material, biological active material, chemical treatment-material, or lubricating material. In specific embodiments, the treatment-material being used is dye material, optionally together with a coating and/or lubricating material.

In certain embodiments of the thread treatment machine of the invention, each treatment-material delivery unit/system 700 is connectable to a respective cartridge containing the same or different thread treatment-material, such that the desired treatment effect, set at the treatment plan data, received from a remote end device or inputted directly into the communication and control unit, is achieved, e.g. by controlling the quantity of treatment-material injected from each cartridge over the passing thread portion, the speed of injection thereof, the order of injection, etc. In alternative embodiments of the thread treatment machine of the invention, each treatment-material delivery unit/system 700 is connectable to a respective cartridge containing the same or different thread treatment-material, such that the desired treatment effect as set at the treatment plan data, is achieved by controlling the quantity of treatment-material injected from each cartridge into said microfluidic mixer and from there over the passing thread portion.

In certain embodiments, the thread treatment machine of the invention further comprises at least one thread-guiding set configured for directing the thread over the orifices within said treatment head and through the entire thread treatment machine. In specific embodiments, said thread-guiding set is responsible for directing the thread towards and onto the treatment head. In other embodiments, said thread-guiding set is further responsible for guiding the thread through all the components of the thread treatment machine, and optionally also towards and/or within any thread application machine integrated with the thread treatment machine of the invention. In certain embodiments, said thread-guiding set enables passing the thread through the entire thread treatment machine upon placing the tip of the thread at the beginning/opening of said thread treatment machine. In yet other specific embodiments, said thread-guiding set comprises at least one thread roll holder and at least two directing rollers. In other specific embodiments, said thread-guiding set further comprises a guiding member with a guiding conduit for directing the thread to pass therein, said conduit comprising openings located over the orifices within the treatment head for allowing the treatment-material to be injected/delivered onto the passing thread. In other specific embodiments, said thread-guiding set further comprises a mechanism for adapting the width 133 of the guiding conduit within said treatment head according to the thread type and thickness being used.

In certain embodiments of the thread treatment machine of the invention, the treatment-material fixation (post-treatment) unit 444 comprises a curing means including at least one of: UV-based radiating system, heating system, drying system, and pressure system.

In certain embodiments, the thread treatment machine of the invention further comprises at least one pretreatment unit/system for pretreatment of the thread prior to delivery of the treatment-material thereto. In specific embodiments, said at least one pretreatment unit comprises at least one of: steaming unit, heating unit, chemical treatment, corona discharge (surface treatment with high voltage discharge in air), plasma treatment (surface treatment with high voltage discharge in different gas media) and untangling unit.

In certain embodiments, the thread treatment machine of the invention further comprises a pre-treatment mechanism/unit 333 for the treatment-material. In specific embodiments, such pre-treatment mechanism 333 comprises a mixing or heating mechanism within or surrounding the treatment-material's container, for heating or cooling the treatment material prior to its application onto the passing thread. In yet another specific embodiment, said pre-treatment mechanism 333 is an activation mechanism and/or a chemical activation/modification mechanism or process.

In certain embodiments, the thread treatment machine of the invention further comprises at least one post-treatment unit 444 for post treating the thread after the delivery of the treatment-material thereto. In specific embodiments, said post-treatment is sublimation of excess of the treatment material, thereby eliminating the need for washing the treated thread for the removal of treatment-material's residues. Accordingly, in other specific embodiments, said at least one post-treatment unit 444 comprises at least one of: (i) washing unit and/or squeezing/abrasion unit for removing excess treatment-material from the thread; (ii) coating unit for applying binding material, lubricant and/or other coating material onto the treated thread; (iii) heater for heating the treated thread and sublimating residues of treatment material and/or its solvent; and (iv) a dryer for drying the treated thread.

In certain embodiments of the thread treatment machine of the invention, the treatment plan data comprises at least one of the following parameters: temperature zones, thread tension, treatment-material applying speed, length of treatment portion, pretreatment, fixation procedure, thread curing, thread heat set parameters, chemical parameters, pre- and post-treatment parameters; thread type (e.g. material, fiber shape, fiber count, thread twist, manufacturer, etc.).

In certain embodiments, the thread treatment machine of the invention further comprises an integration mechanism configured for integrating said thread treatment machine into- or together-with a thread application machine, such as: a sewing machine, an embroidery machine, a quilting machine, a knitting machine or a weaving machine. In specific embodiments thereof, said communication and control unit is further configured for controlling: (i) the pulling and directing of the thread for coordinating the pace of the pulling and guiding of the thread over the treatment head; and optionally (ii) the operation of the additional thread application machine being used.

In specific embodiments of the thread treatment machine of the invention, the treatment-material is a dye for coloring the thread, and said at least one communication and control unit is adapted to control at least the timing of applying the dye from each cartridge according to at least one of: a desired color tone for the respective thread portion passing through; the thread characteristics; the moving pace of the thread portion; and the spacing between the orifices at the treatment head.

In alternative specific embodiments of the thread treatment machine of the invention, the treatment-material is a dye for coloring the thread, and said at least one communication and control unit is adapted to control the mixing of the dye within a microfluidic mixer, if present, and the timing of applying the dye therefrom according to: a desired color tone for the respective thread portion passing through; the thread characteristics; the moving pace of the thread portion; and the spacing between the orifices at the treatment head.

In yet other specific embodiments, the thread treatment machine of the invention further comprises color identification unit 900 for identifying the resultant color—either within the microfluidic mixer prior to its delivery to the thread or directly on the dyed thread, or both.

In further specific embodiments of the thread treatment machine of the invention, in which the treatment material(s) is a dye(s), the communication and control unit is further adapted to compare the resultant color tone with the desired color tone and adjust the mixing of the dye within the microfluidic mixer, if present, and/or the timing of applying the dye from each cartridge, and/or control any other treatment parameter within the thread treatment machine, until reaching the desired color tone, e.g. speed and amount of applying the dye, pre- and post-treatments, distance between adjacent orifices, etc.

In certain embodiments, the thread treatment machine of the invention further comprises a vacuum/low-pressure generating system 800 for reducing the pressure at the treatment head and/or within the entire machine and/or at the post-treatment unit 444, below ambient pressure, and/or air flow (in or out) system for blowing air in or out of the head and/or drying system.

The thread treatment machine of the invention is adapted to receive treatment parameters determining the treatment-materials to be used for each thread portion to be treated and optionally any other parameter such as thread type to be used, pre- and/or post-treatment procedures etc., all configured through a treatment plan data structure that is readable by the machine.

According to some embodiments, the same thread treatment machine of the invention can be used for different treatment types and purposes by changing the treatment-material cartridges and/or the treatment head. For these embodiments, the thread treatment machine has to be programmed such as to allow receiving different types of treatment plans for differently treating different kinds of threads having different thickness, rigidity, material type and strength, different symmetry (e.g. adapted to treat and advance threads of radial symmetry or flatten film like threads and the like), and tensile strength, etc. For example, the same machine can be used to treat thread portions used for surgical suture by adding thereto medical materials and/or thread strengthening materials and/or lubricants, to fit the particular surgery type and patient as well as for coating other types of threads for adding electric conductivity isolation thereto or for dyeing thread portions. To do so, a designated application, operable either at the communication and control unit at the machine, or via a remote user device such as a smartphone or separate computer and the like, receives input from the user indicative of the treatment required out of selectable options provided in a user interface thereof. Once the treatment input is set, the application processes the input data to create and output a treatment plan indicative of simple machine readable parameters such as cartridges numbers to be used, injection quantities and timing thereof, and/or pre-mixing of the treatment materials at a microfluidic mixer, for each thread portion to be treated. The machine can be "blind" to the type of treatment required as input but simply operate the injectors and thread guiding means and optionally its pre- and/or post-treatment unit/means 333,444, without identifying the actual treatment and material it uses. The user of the machine will be required of course, to place the right cartridges in the right locations according to a treatment type cartridges setup adapted to each treatment type in order for the thread treatment to be performed.

It should be noted that the terms "thread guiding means", "guiding conduit", and "guiding set", are used interchangeably throughout the application, and refer to any suitable mechanism(s) or unit(s) designed to guide a thread as it passes from its roll 91 and through said thread treatment machine 100. The number of guiding means is determined according to the system being used and the system's and user's requirements, and may be 1, 2, 3, 4, or more. These guiding means are located at any point needed to guide the thread to a desired location/direction, and may also assist in maintaining the thread tension. Such guiding means include, for instance, the treatment head 130, various rollers (e.g. 121-124), designated loops and tubes, weights, channels, etc.

Additionally or alternatively, the thread treatment machine of the invention can be used for providing several identical or different treatments to the same thread or different treatment for each thread portion following a single treatment plan. For example, the machine can be used as a thread coating machine for strengthening the thread as well as for providing a furnishing effect to the thread and as a thread dyeing machine. In certain embodiments, all cartridges of the machine but one may be dye cartridges while the last cartridge contains coating material for coating the thread portions right after they were dyed. In a specific embodiment, the machine of the invention further comprises an additional cartridge containing a lubrication material for lubricating the treated/dyed thread, optionally after the fixation of the treatment material on the treated/dyed thread. In this way, each portion of the thread may be applied to with a different mixture of treatment materials/dyes to achieve a different outcome/color tone for each portion of the thread, but the entire treated/dyed thread section can be lubricated and/or coated with the same coating material without requiring replacement of the threads or cartridges. In a specific embodiment, the lubricant and any other coating material are located/placed within the same cartridge.

In specific embodiments, the thread treatment machine of the invention is a threads dyeing machine, which has multiple dye injectors, each connected to a cartridge of a different dye such as a different basic color or effect dye for dyeing each thread portion by passing the thread over the orifices at the treatment head and applying droplets of dye material over the passing thread portion using, e.g., gravitation such that the blending of the dyes make out the desired color tone indicated in the received data. The blending can be done over the thread as each dye is applied (injected) over the same thread portion (spot) at different time frames or simultaneously or by applying a pre-mixed ink (premixed in a microfluidic mixer) for achieving the desired color tone. In specific embodiment, when using pre-mixed ink, the premixing is done digitally at the needed amount just before applying the mixture onto the thread.

In an alternative embodiment of the thread dyeing machine of the invention, said multiple dye injectors are configured to apply the treatment-material (e.g. dye) onto a thread passing above said orifices, i.e. against gravitation.

According to certain embodiments, the thread to be dyed by the thread treatment machine of the invention is of a single base color which is preferably but not necessarily bright/light colors (e.g. white or off-white) requiring the user to only acquire a thread roll of a single color for achieving any desired color tone he/she wishes to produce at any desired thread portion length without having to buy different rolls for different colors and searching for desired tones. In some embodiments, the machine allows using the same thread for producing a multi-colored thread having two or more color tones in any order set by the user.

The present invention further provides a system for treating threads or portions thereof comprising: an application module, optionally operable via an end-user device having a user interface, the application module being configured for inputting treatment related data associated with at least one desired treatment effect for thread portion treatment, setting a machine readable treatment plan comprising TRP data based thereon and transmitting the treatment plan data to the thread treatment machine (optionally remote) over at least one communication link; and a thread treatment machine as defined above comprising: at least one cartridge configured for containing treatment-material therein; at least one injector each connectable to one of the at least one cartridge, each injector being configured for applying thread treatment-material from its respective cartridge over a passing portion of a thread; at least one drive means for operating the at least one injector; and a communication and control unit, e.g. for communicating with remote end-users' devices and receiving therefrom TRP data, and for controlling quantities of treatment-material outputted by each injector at each given timeframe for controlling the treatment effect of each passing thread portion, according to the received TRP data.

According to specific embodiments, in which the thread treatment machine is used for dyeing the thread and having dye treatment-material in its one or more cartridges, the application module further uses image acquiring means, e.g. of the end device on which it operates, for having the user acquire an image of the desired at least one color tone for thread dyeing together with a colors chart, the application module further being configured for operating an image processing algorithm for identifying the desired at least one color tone from the acquired image.

In certain embodiments, the present invention provides a system for treating threads or portions thereof, said system comprising: (a) a thread treatment machine of the invention as defined herein; and (b) an application module operable via a user end device having a user interface, said application module being configured for: (i) inputting treatment related plan data associated with at least one desired treatment effect for a thread portion treatment, (ii) setting a machine readable treatment plan comprising treatment related parameters (TRP) data based thereon, and (iii) transmitting said treatment plan data to said thread treatment machine over at least one communication link.

In specific embodiments of the system of the invention, the thread treatment is dyeing, and said application module uses image acquiring means, e.g. at the users' end device on which it operates, for having the user acquire an image of the desired color tone for thread dyeing and a colors chart, said application module being configured for operating an image processing algorithm for identifying the desired at least one color tone from the acquired image. In other specific embodiments, the user interface provides graphical tools for displaying the acquired image and for enabling the user to select at least one area in the acquired image in which the desired color tone is displayed. In yet another specific embodiment, the user interface provides selection tools enabling the user to select a desired color tone from a predefined chart of colors displayed for selection using display means of the end device.

In further specific embodiments, when the system and/or the thread treatment machine of the invention is used for threads dyeing, it includes a designated application (software) designed to allow a user to acquire an image with one or more desired color tones therein e.g. by photographing an object with one or more areas having one or more desired color tones therein while also photographing in the same picture or a sequential one a designated color chart under the same photography conditions such as the same illumination and/or shading conditions. The image of the chart is then used by the software for identification of the color tone in the image by building a color model and further matching the desired color to the exact dyes mixture required for achieving that color tone.

The color chart may be a physical card or element that has all colors/color tones available by the machine printed thereover or a threads element having a large number of threads dyed with different color tones achievable by the particular dyeing machine of the system. In other words, the chart covers the entire color gamut achievable by the particular dyeing machine. This chart may be adapted according to commercial requirements and/or acquired statistical knowledge depending of course on the available dye cartridges materials and tones and the resolution of the machine of the invention i.e. its ability to control injection of extremely small portions of dye from its injectors.

The photographed image can then either be processed automatically via a designated image analysis algorithm of the designated application using any processing means, e.g. of the user's end device. The algorithm may automatically identify the color tone that is desired from the image by using the image of the colors chart therein. Alternatively or additionally, the designated application provided a graphical user interface (GUI) that allows the user to select the image area(s) with the desired color tone(s) and optionally also indicate the location of the color chart in the same image for the algorithm to use this data for identification of the one or more desired color tones. The identification may be done for instance by using methods such as the Simplex Lattice Models and Multiple Linear Regressions to identify which available dyes should be used for achieving the exact desired color tone.

Optionally, the GUI also allows users to select other dyeing such as thread portion length(s) for each color tone or for all tones to be dyed and the like.

In further specific embodiments, the designated application also allows calculating or receiving as input additional parameters required for the overall calculation of the dyeing process, e.g. dyes quantities and selection, for achieving the color tone of desire such as tension strength, rate of transfer, thickness, saturation, ink (dye) viscosity, and ink solvent, some of which may also be a combination (synergetic) of others.

The overall parameter required to calculate the dyes/materials quantities and selection, whether known as default, inputted by the user or set by another machine user or calculated from other input and/or known parameters, are referred to herein as the treatment related parameters (TRP) of the treatment plan, indicating all data required for the thread treatment machine or system to operate such as to produce the required treatment effect for the specific thread and with the specific materials it uses. Once all the parameters are inputted, e.g. by the user, data indicative thereof is transmitted to the communication and control unit through a communication link to have it finalize the collection and/or calculation of the overall TRP data it requires to begin treating the thread or portions thereof accordingly. Upon receiving the treatment plan and TRP data, the thread treatment machine guides the thread over the orifices at the treatment head, operates the injectors in the right timing and speed for each to inject the calculated quantity of treatment-material from the cartridge thereof over the passing thread portion for achieving the desired treatment effect over each portion of the thread. If a microfluidic mixer is present in the machine, it operates the injectors so as to obtain an accurate mixing of the treatment-materials within said microfluidic mixer and applying same over the passing thread portion for achieving the desired treatment effect over each portion of the thread.

The thread portions length can be a default value of the system or may be adjustable by the user or by the machine operator and/or be part of the TRP data. The adjustment of the thread portions length for treatment may be done directly through a designated control panel installed over the thread treatment machine itself or received as part of the input data transmitted from a user's end device, in which case the application is also configured to allow users to input thread portions lengths.

In other specific embodiments, the system of the invention further comprises a vacuum/low-pressure generating system 800 for reducing the pressure at the treatment head and/or the thread treatment machine and/or the pre- or post-treatment unit 333,444 therein, below ambient pressure, and/or air flow (in or out) system for blowing air in or out of the head and/or drying system.

In some embodiments, the user interface provides graphical tools for displaying the acquired image and for enabling the user to select at least one area in the acquired image in which the desired color tone is displayed.

According to some embodiments, the user interface provides selection tools for having the user select a desired color tone from a predefined virtual chart of colors displayed for selection using display means of the end device.

In certain embodiments, the hardware and/or software of the thread treatment machine or system of the invention is programmed to take into consideration one or more thread properties such as thread color, material, thickness and the like for optimizing the achieving of the desired treatment effect. For example, the thread base color may be an important parameter to consider for thread dyeing for achieving the exact color tone that is desired. The thickness and material type of the thread may also be important to many treatments types since effects, such as drying of the treatment-material, absorbency of the treatment-material over or inside the thread, etc., depend on such thread properties and may determine the amount of treatment-material(s) required for the treatment for achieving the purposes of the treatment plan and/or the need for pre- and/or post-treatment procedures.

In certain embodiments, the thread treatment machine and system of the invention include pre- and/or post-treatment means 333,444 such as curing means for example for optimizing drying time of the treatment-material over the thread, e.g. by heating and/or drying and/or by using ultraviolet (UV) curing means or steam/dry, or any other curing means. Such pre- and/or post-treatment unit/means 333,444 may utilize the application of binder(s) and/or lubricants. In specific embodiments, when the thread treatment is dyeing, the binder and/or lubricant are applied as a post-treatment. In other specific embodiments, when other thread treatments are applied, e.g. medical application, the thread pretreatment may include application of priming material for locking/binding a drug to the treated thread.

The present invention further provides a method for treating threads comprising the steps of: providing a thread treatment machine having a communication and control unit and at least one injector, each injector being configured for injecting a treatment-material therefrom, over a passing by thread portion for treating thereof, the injectors are controllable by the communication and control unit; providing an application module, operable via an end device of a user having a user interface, the application being configured for inputting data associated with at least one desired treatment effect, determining treatment related parameters (TRP) for setting a machine readable treatment plan data based thereon and transmitting the treatment plan data to the thread treatment machine over at least one communication link; receiving the treatment plan data from the end device of the user; and directing a thread through a guided path over or below orifice of the at least one injector, using at least one, two, three or more guiding means; and applying at least one treatment-material from at least one injector over at least one thread portion of the guided thread according to the received treatment plan data.

In certain embodiments, the present invention provides a method for treating threads comprising the steps of: (a) providing a thread treatment machine according to the invention being configured for injecting a treatment-material over a passing thread portion for treating thereof, and controllable by said communication and control unit; (b) providing an application module, optionally operable via a users' end device having a user interface, said application module being configured for inputting treatment plan data associated with desired treatment effect(s), determining treatment related parameters (TRP) for setting a machine readable treatment plan data based thereon, and transmitting said treatment plan data to said thread treatment machine; (c) receiving the treatment plan data from the users' end device; (d) directing a thread through a guided path over the treatment head of said thread treatment machine, optionally by using a guiding means; and (e) applying at least one treatment-material from said cartridge(s) over at least one thread portion of the guided thread according to the received treatment plan data, thereby obtaining a treated thread.

In specific embodiments of the method of the invention, the treatment is dyeing and said TRP data comprises the color tone for each thread portion and/or length of each thread portion to be dyed for dyeing treatment of the thread.

In other specific embodiments of the method of the invention when the treatment is dyeing, the application module uses image acquiring means, e.g. at a users' end device on which it operates, for having the user acquire an image of the desired color tone for thread dyeing and a colors chart, said application module further being configured for operating an image processing algorithm for identifying the desired at least one color tone from the acquired image.

In specific embodiments of the method of the invention when the treatment is dyeing, the user interface provides graphical tools for displaying the acquired image and for enabling the user to select at least one area in the acquired image in which the desired color tone is displayed.

In specific embodiments of the method of the invention when the treatment is dyeing, the user interface provides selection tools for having the user select a desired color tone from a predefined virtual chart of colors displayed for selection using a display means, such as a display means of a user's end device.

In specific embodiments, when the treatment is dyeing, the method of the invention further comprises a step of identifying the resultant color. In a specific embodiment, the identification of the resultant color is carried out directly on the dyed thread. In an alternative specific embodiment, when the thread treatment machine comprises a microfluidic mixer, the identification of said resultant color is carried out on the color mixture within said microfluidic mixer prior to its delivery to the thread and/or directly on the dyed thread.

In specific embodiments, when the treatment is dyeing, the method of the invention further comprises a step of comparing the resultant color tone with the desired inputted color tone and adjusting the mixing of the dye within the microfluidic mixer, if present, and/or the timing of applying each dye from each cartridge, until reaching the desired color tone. In certain embodiments, said comparing step is carried out constantly or periodically in predefined time intervals. In certain embodiments, if the thread treatment machine determines that the identified resultant color differs substantially from the desired color and there is no possible way it can reach the desired color, e.g. since one of the colors depleted, it may stop working and/or send out an alert to the user.

In specific embodiments, the method of the invention further comprises a step of generating vacuum/low-pressure for reducing the pressure, e.g. at the treatment head and/or at the post-treatment unit 444, below ambient pressure, and/or air flow (in or out) system for blowing air in or out of the head and/or drying system, thus facilitating faster employment of the treatment-material and fixation thereof.

Reference is now made to FIG. 1, showing a system 1000 for treating thread portions, according to some embodiments of the invention. The system 1000 includes a thread treatment machine 100, a communication and control unit 200 connected thereto and a designated coloring (software) application 81 operable through an end device 80 of a user. The system 1000 optionally also includes one or more remote servers such as server 82 for remotely operating the application by having at least some of the calculations thereof done over the server's 82 processor(s).

As mentioned above, the application module 81 uses devices and means of the end device 80 such as communication, images acquiring means (one or more stills and/or video camera), memory means, display and output means as well as processing means for receiving input data from which the treatment plant is to be determined and set, e.g. by having the user acquiring an image of objects with desired one or more colored tones for dyeing threads according thereto, and of the reference color chart to be used and for input data thereby for allowing the application to calculate one or more dyeing parameters for the machine to dye the thread or portions thereof thereby. The output of the analysis and inputting process results in a treatment plan data file containing thread treatment parameters data such as dyeing parameters data in a format that can be read and used by the thread treatment machine 100 for controlling the injectors and other means of the machine such as the thread guiding means, etc. according to the received treatment plan data.

In cases in which the system 100 is used for dyeing threads, an element 50 containing a color chart may be provided to the user of the application or printed by the user for photographing thereof when photographing objects for color tone selection. The colors in the chart are adapted to the dyes available in the machine and all tones and effects that can be achieved by mixtures thereof. Therefore the image analysis can directly identify the color tone code for the machine from the image of the chart. This code is indicative to the quantities and types of dyes of the machine required to achieve the exact tone.

Additionally or alternatively, a color table may be offered to the user through the application GUI for allowing the user to create a desired color tone by virtually mixing the available dyes as indicated visually through the GUI or select dye effects thereby.

Reference is now made to FIGS. 2-5, which show a thread treatment machine 100 of some embodiments of the present invention, or parts thereof. The thread treatment machines 100 as illustrated include one or more supporting structures such as support structure over which holding boards 152 and 153 are installed; injector sets 110*a*-110*e* having syringe injectors 10*a*-10*e* and means for controlling and operating thereof thread holding and directing means including rollers and holders 121-123 and a guiding member for guiding portions of the thread over orifices at the treatment head 130 connected to tubes 12 leading from said injector sets 110*a*-110*e*.

The thread treatment machine 100 is designed to connect to a communication and control unit for receiving treatment parameters data (treatment plan), optionally from remote end devices, and for controlling motors 30 that ultimately control the injection operation of each injector.

According to some embodiments, as shown in FIGS. 2-3, each injector set 110*a*-110*e* includes: (1) a syringe injector 10*a*-10*e* integrated-with or connected-to a cartridge containing the treatment-material, wherein the cartridge of treatment-material is combined with a piston connected to a tube 12 that connects to a treatment head 130 having very small orifices for outputting extremely small amounts of treatment-material therefrom for improving injection control; (3) motor such as a stepper motor 30 having a torque plate 31; and (4) a micrometer set 20 each having a micrometer head 21 laterally displaceable by the stepper motor 30 via its torque plate 31, where the head 21 connects to a pusher 22 held by a micrometer holder 23.

The orifices of the injectors can be aligned in a raw spaced from one another in a distance that optimizes, e.g. drying and absorption time of each treatment-material being injected before that treated thread portion is advanced to the next adjacent orifice.

Figure 2A:
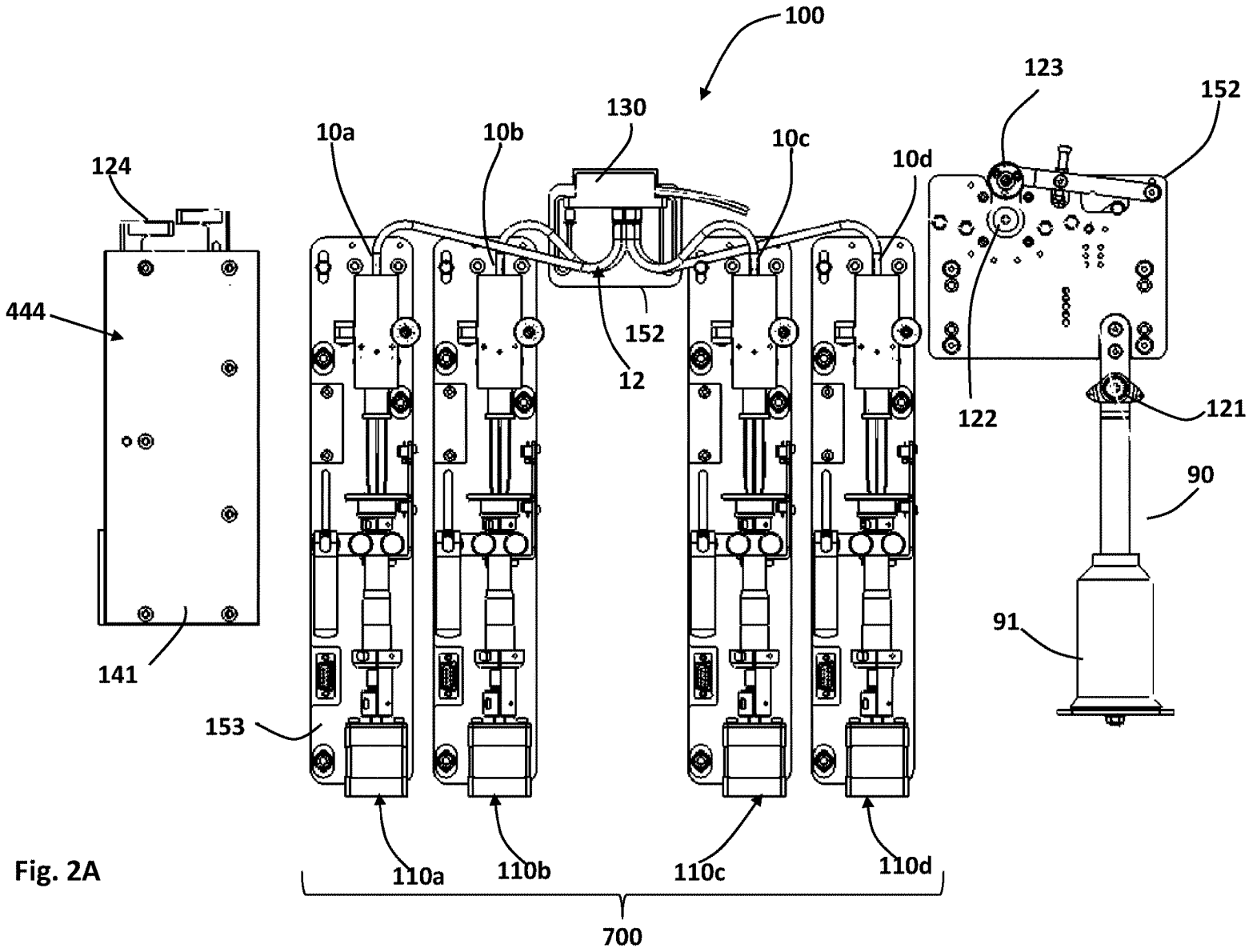
FIGS. 2A-2G show frontal views of several possible thread treatment machines, according to some embodiments of the present invention.

As shown in FIG. 2A, a roll 91 of thread 90 optionally having a single basic color is placed over a roll holder (hidden) of the thread treatment machine 100 and passed through the holders and roller guiding elements 121-124 for maintaining the thread in an optimal tension (exceeding a minimum tension threshold) over the orifices at the treatment head 130. One or more motors can be used for moving the thread 90 in a forward direction by rolling the holder of the thread roll 91 and the holders/rollers 121-124. For example, a single motor can be used for controlling rotation of a holder holding the thread roll over which the thread involute. In a specific embodiment, the tension of the thread 90 as it is being pulled from its roll 91 is maintained constant by using specific roller guiding elements 121-123, such as to enter said thread 90 into said treatment machine 100 at a predefined tension as required according to the treatment plan. In another specific embodiment, the treatment machine 100 further comprises at least one additional roller guiding element 124 designed to maintain the tension of the thread 90 constant as it passes over the treatment head (guiding member) 130 and its orifices 132. In yet another specific embodiment, said roller guiding elements 121-124 adjust the tension of the thread 90 according to the treatment plan as well as any tension shifting/modification of the thread as it passes in the treatment machine, e.g. due to thread tear, thread roller malfunction, etc.

Figure 2B:
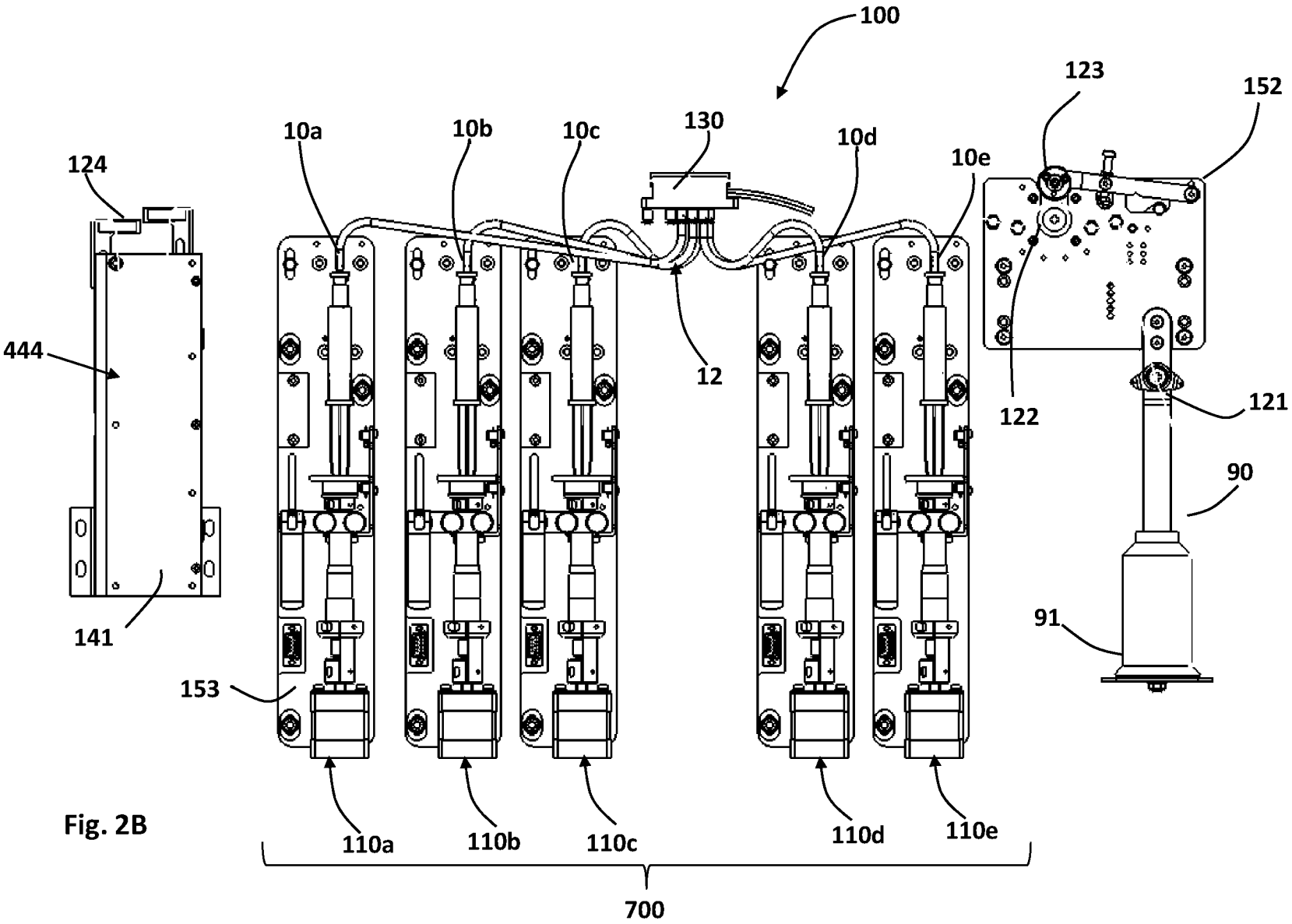

FIG. 2B describes the path of a thread through the thread treatment machine 100: a spool of thread 91 positioned on a fixed plate allowing the thread 90 to be unwind towards the top; a motor roller is rotating against another roller while the thread sits in between the two rollers 122-123; as a result, the thread 90 advances from the spool 91 towards the treatment, e.g. coloring, head 130. In order to prevent thread entanglement during the unwinding from the spool 91, a friction element 121 is positioned between the feeding spool 91 to the motor roller 122-123. A set of dispensers 110*a*-110*e* are connected to the treatment head 130 using hoses/tubes 12 to supply treatment-material, such as ink when the treatment is dyeing. Each of the dispensers 110*a*-110*e* is connected to a nozzle/orifice in the treatment head 130. When the thread 90 passes through the treatment head conduit, it takes up the required amount of treatment-material (e.g. dye) and continue advancing towards, e.g. a drying or fixation system 141 or any other post-treatment system 444. In a specific embodiment, such a drying system may consist of a hot air chamber.

Figure 2C:
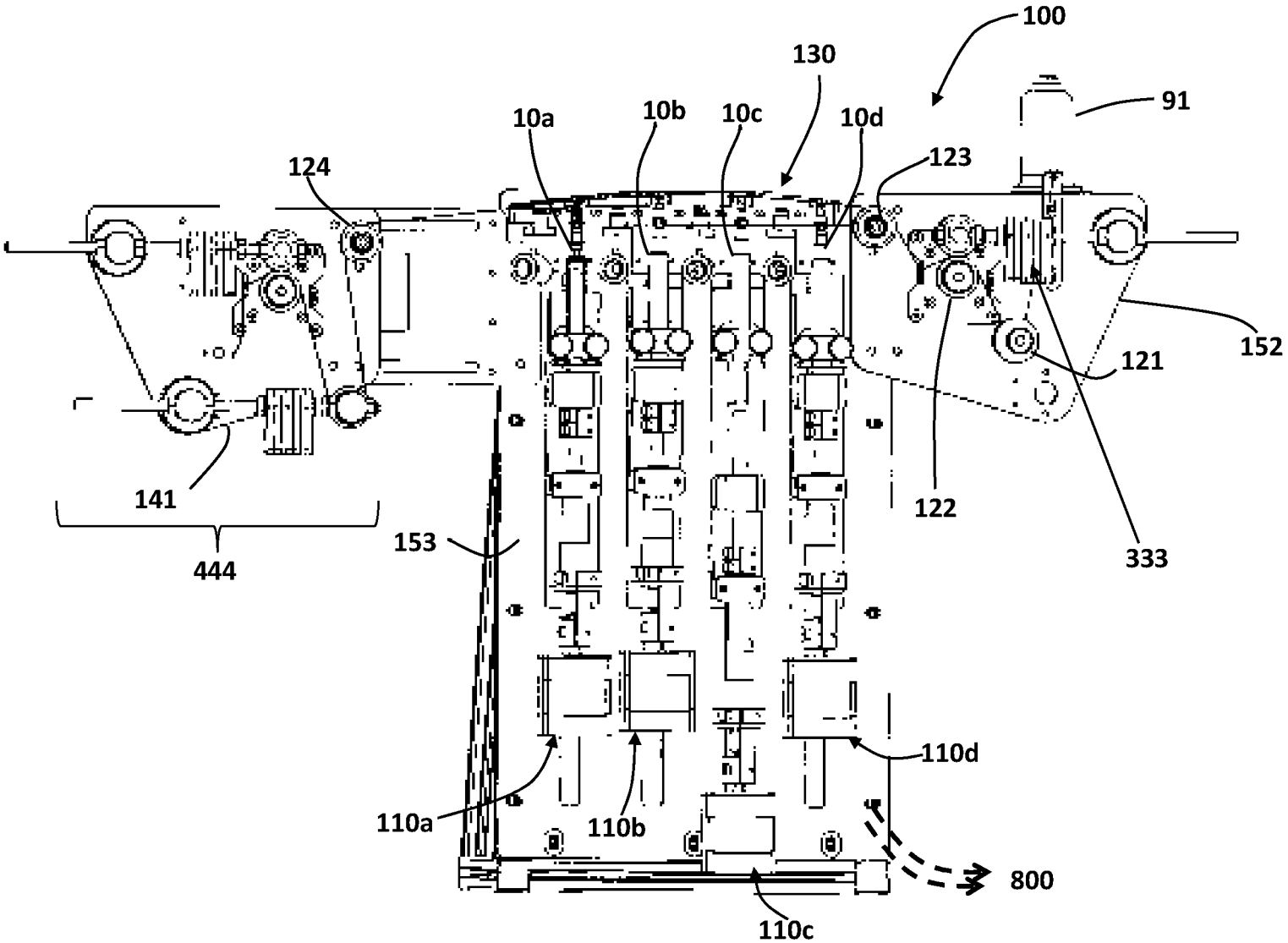

FIG. 2C describes the path of a thread through yet another thread treatment machine 100, in which said injectors/dispensers 110*a*-110*d* are associated directly to said treatment head 130 via needles to supply treatment-material to the passing thread.

Figure 2D:
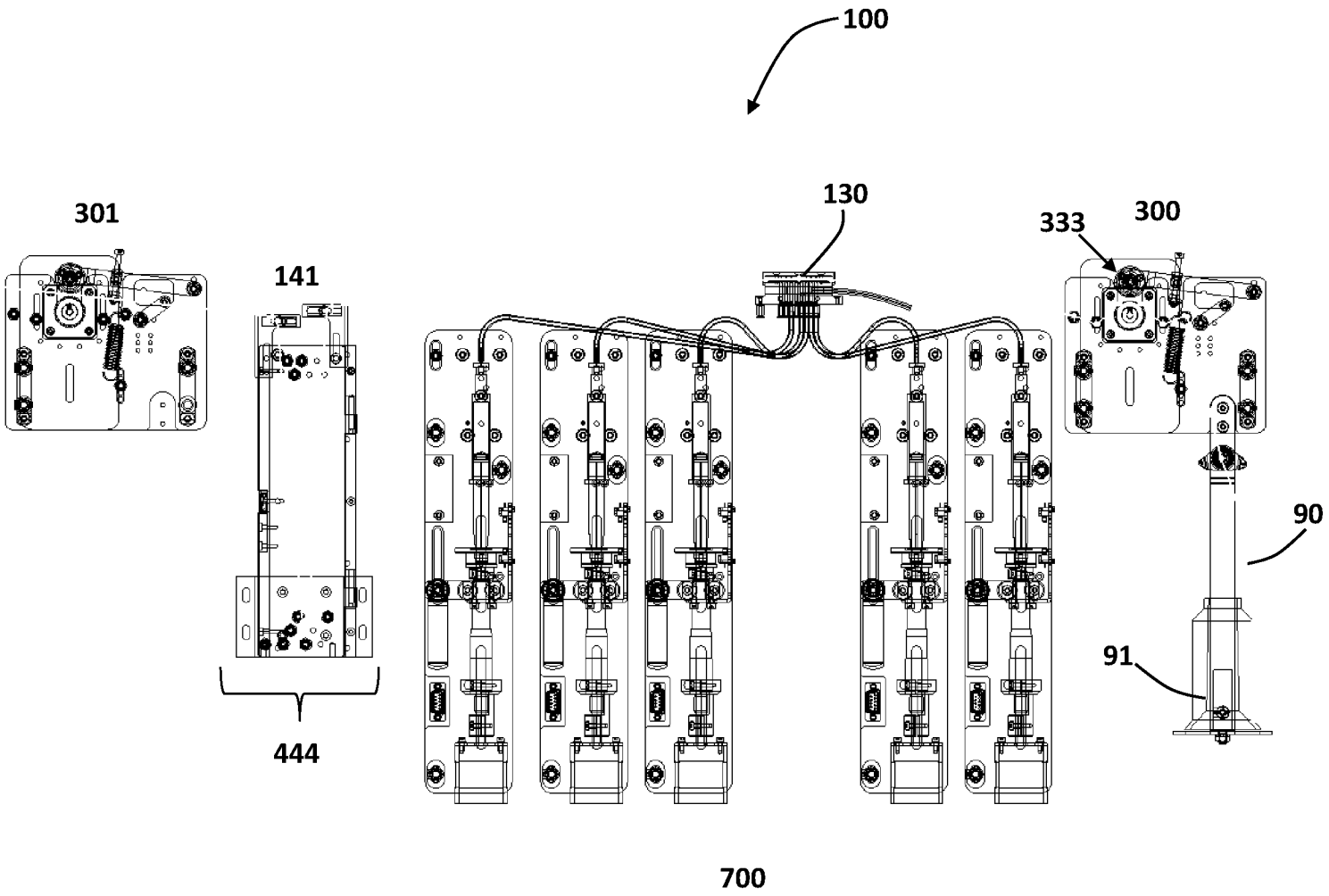
Figure 2E:
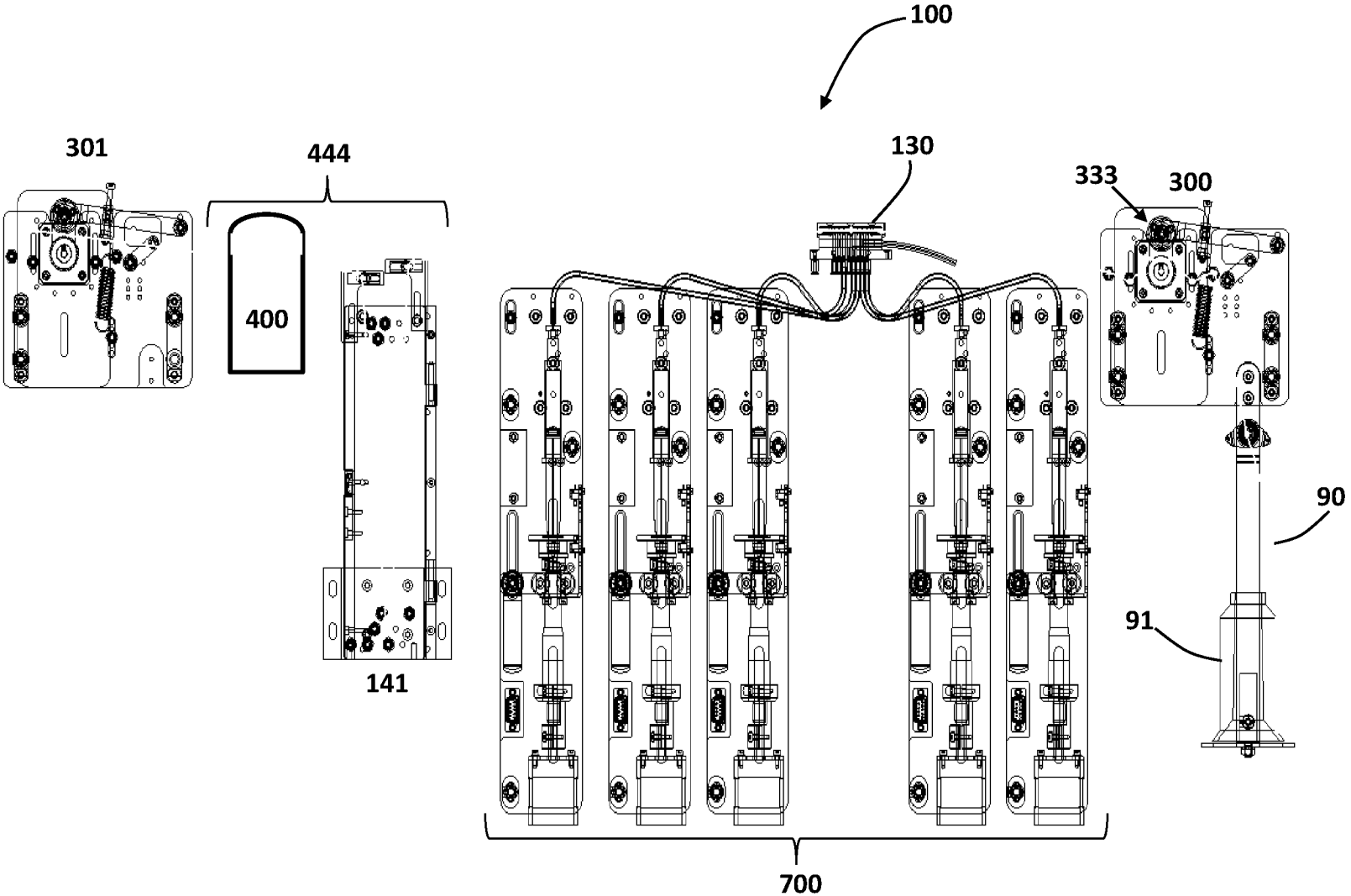

FIGS. 2D-2E describe the path of a thread through yet another thread treatment machine 100, which comprises two thread driving units 300,301 located before and after the treatment process. FIG. 2E further illustrates the addition of a lubrication unit 400 after the treatment, e.g. dyeing, of the thread.

Figure 2F:
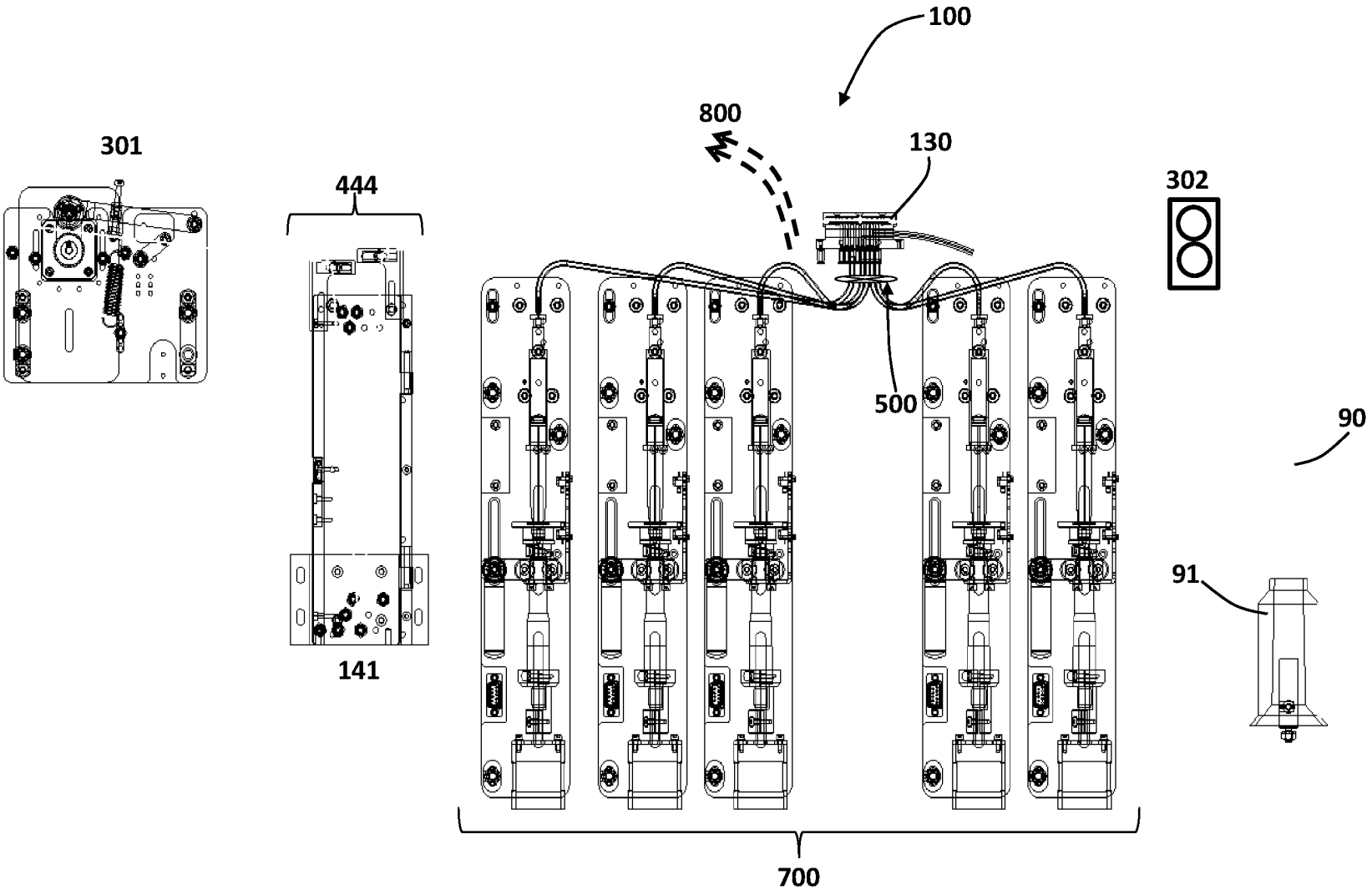
Figure 2G:
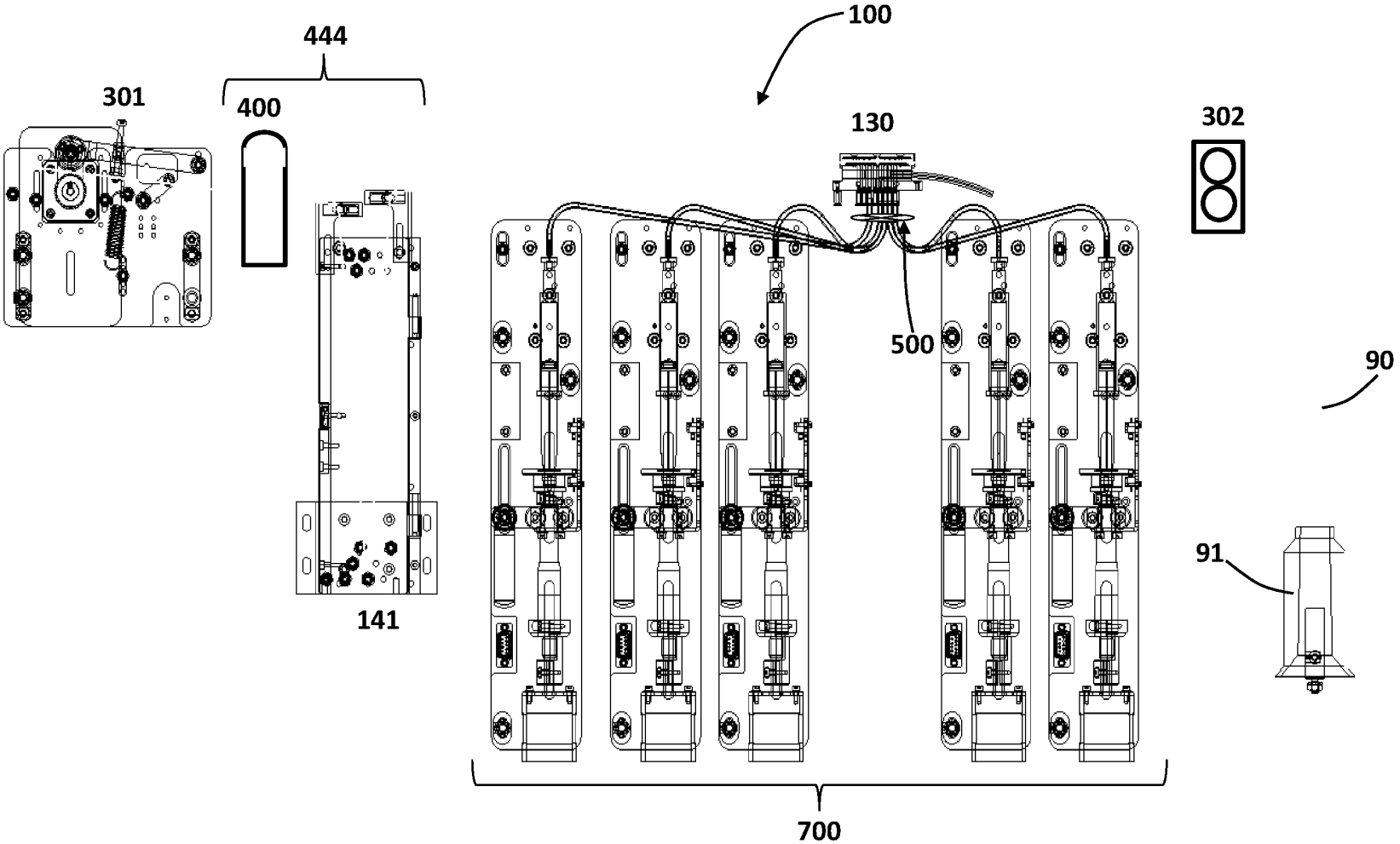

FIGS. 2F-2G describe the path of a thread through yet another thread treatment machine 100, which comprises a single thread driving unit 301 located after the treatment process (i.e. after the treatment head 130 and after the fixation unit 141) as well as a friction unit 302 located before the treatment process. FIG. 2G further illustrates the addition of a lubrication unit 400 after the treatment, e.g. dyeing, of the thread. In addition, FIGS. 2F-2G illustrate a microfluidic mixer 500 located between the tubes leading the treatment material from the containers/injectors and between the treatment head 130.

Figure 3A:
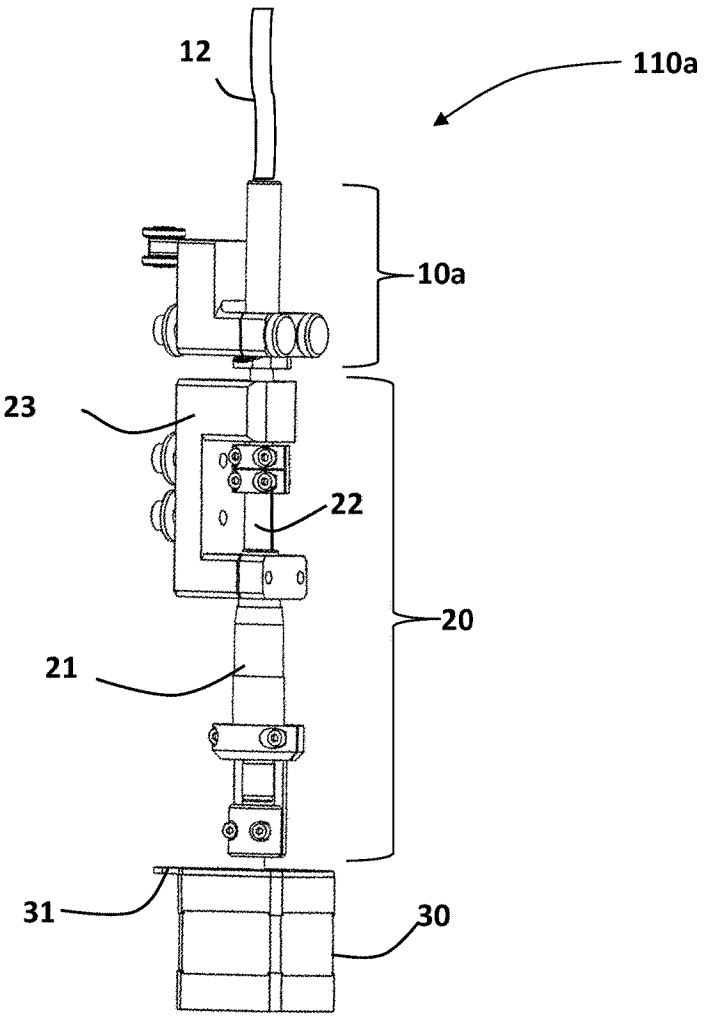
FIGS. 3A-3D show possible configurations of an injecting set of a thread treatment machine according to some embodiments of the invention.
Figure 3B:
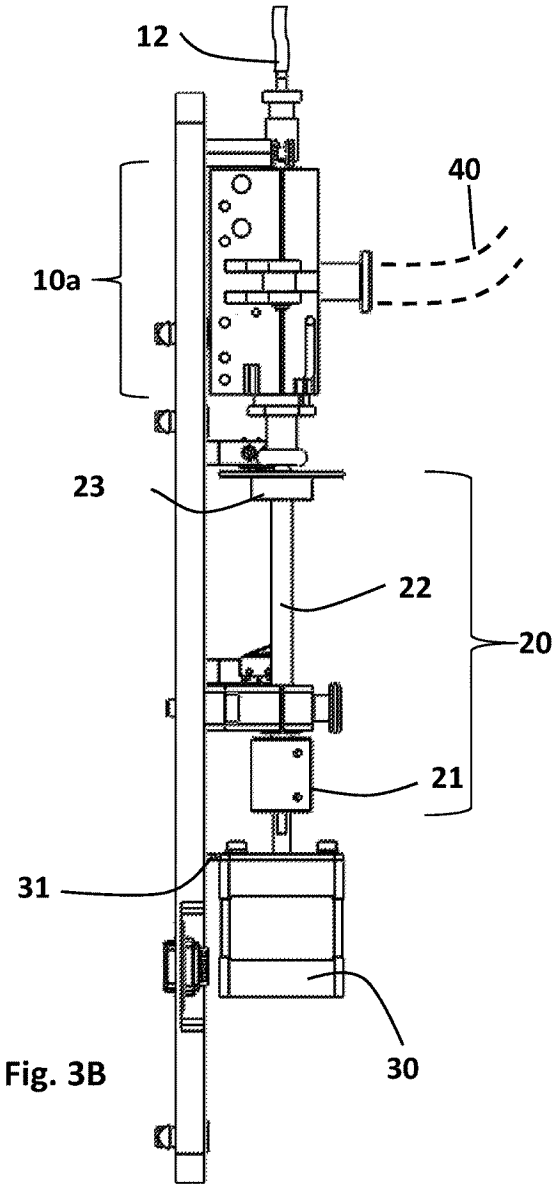

FIGS. 3A-3D provide several possible configurations of an injecting set/dispenser 110*a* used in the thread treatment machine according to some embodiments of the invention. FIGS. 3A-3B describe in principles the operating of a dispenser 110*a*: each dispenser comprises 3 main components: a motor 30, a gear and a canister/container holding the treatment-material. The motor 30 is connected to a micrometer set 20 comprising a fine pitch guiding screw. In these configurations, when the motor 30 rotates, it advances said guiding screw up, causing the piston of the syringe to move up and dispense material out of the syringe through the hose/tube 12 at a very controlled manner (according to the size of the screwing in said fine pitch guiding screw). In specific embodiments, said container holding the treatment-material is either an integral part of the treatment machine or an external container connected to the dispenser 110*a* via a designated tube 40.

Figure 3C:
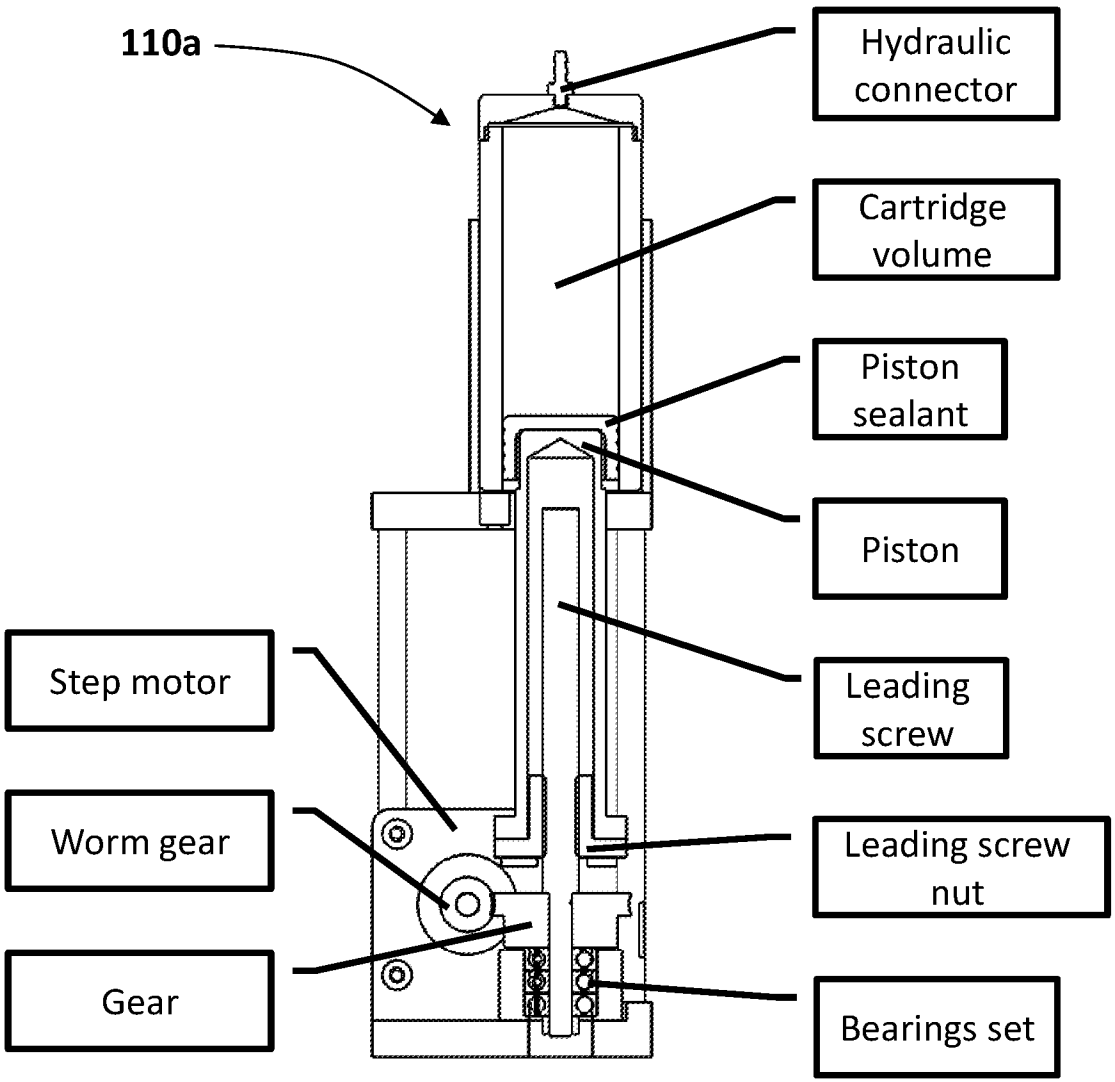
Figure 3D:
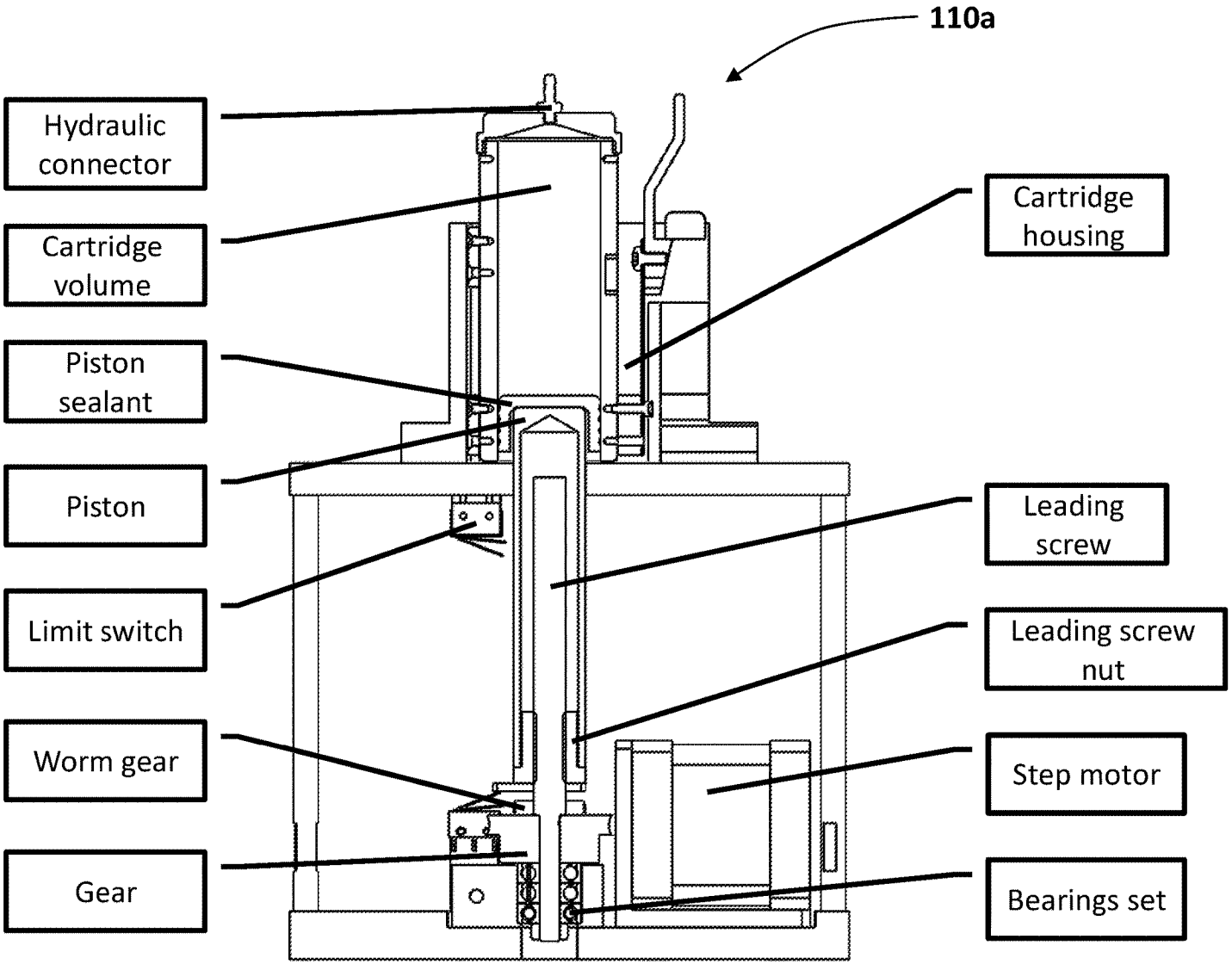

FIGS. 3C-3D provide two additional possible configurations of an injecting set/dispenser of the thread treatment machine of the invention. FIGS. 3C-3D describe in principles the operating of the dispenser 110*a*: each dispenser comprises 3 main components: a step motor, a worm gear and gear, and a cartridge/container holding the treatment-material. The step motor is connected to a worm gear and bearing set, such that when the motor rotates, a leading screw rotates and moves forward pushing against a piston within said cartridge, thereby dispensing the treatment-material out of said cartridge through a hydraulic connector and through a hose/tube at a very controlled manner.

The treatment head/guiding member 130 is shown in detail in the zoom-in views of FIGS. 4-5. The treatment head 130 comprises a conduit 131 for leading a thread over orifices 132 located therein, each orifice is connected to tubes 12 extending from the injectors. In this example, the treatment head 130 is configured as an open channel for directing a thread 90 therein. The conduit 131 has holes/orifices 132 thereover connected to said tubes 12 to allow the treatment-material to pass therethrough upwardly or downwardly onto the passing thread. The conduit 131 channel-like design enables both directing the thread 90 over the orifices, as well as collecting excess treatment-material therein. In some embodiments, the conduit 131 is located also such as to allow engagement between the rims of the orifices 132 and the thread 90 for also cleaning of treatment-material thereby.

Figures 4A, 4B, 4C:
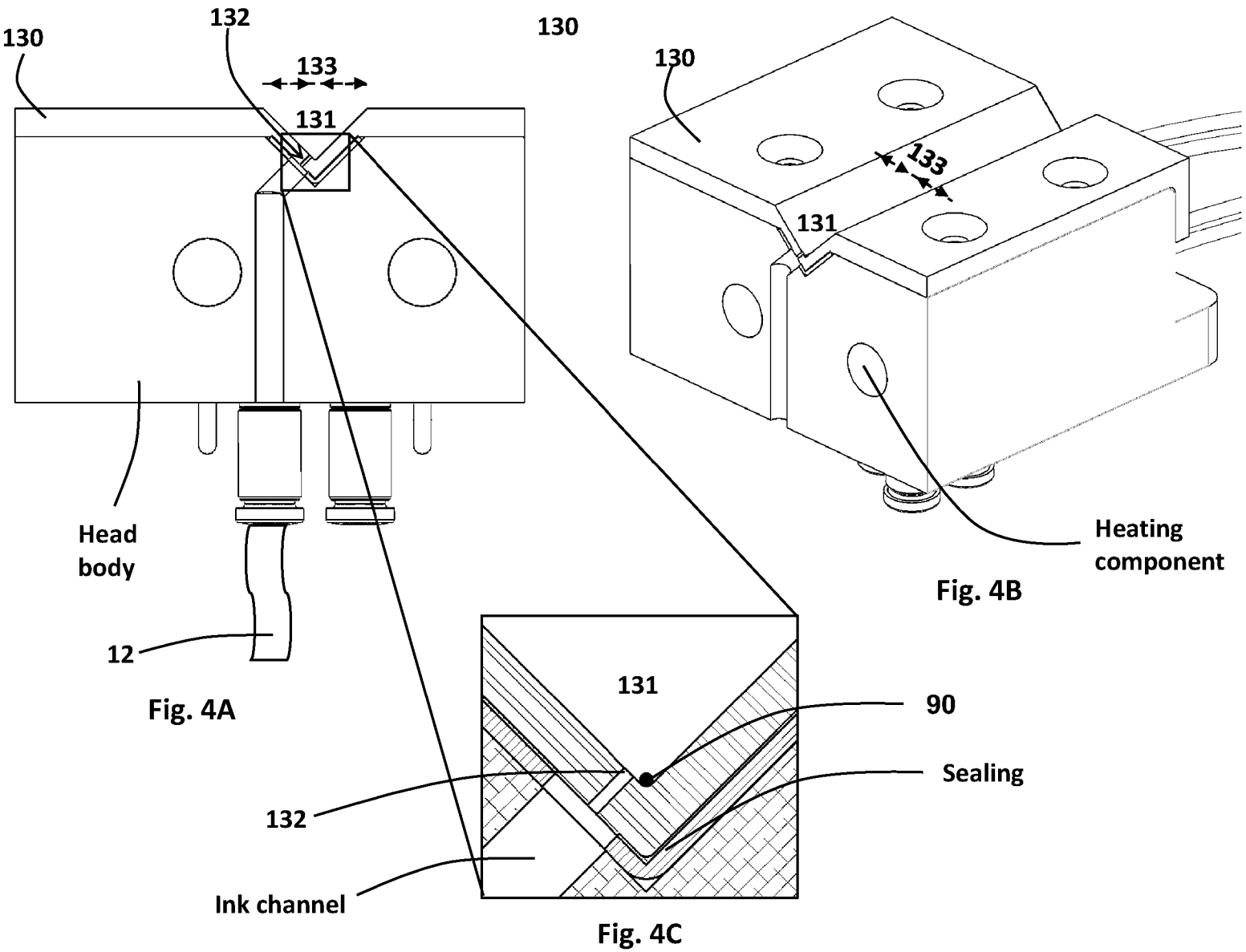
FIGS. 4A-4C are a zoom-in view of a part of treatment head of the thread treatment machine of the invention, showing a guiding member configured for guiding the thread over orifices of treatment-material.

As illustrated in FIG. 4C, the thread 90 passes within the conduit 131 below the opening of the orifices 132. In this constellation, the treatment-material exits the orifices 132 and flows downwards towards the passing thread 90, either by gravitation and/or due to suction forces created between the thread and the material.

Figure 5A:
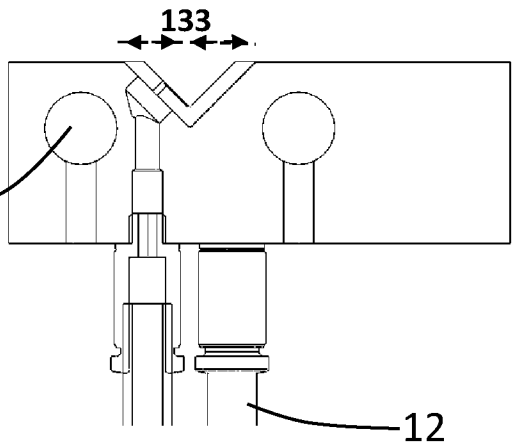
FIGS. 5A-5C show cross sectional views of a part of the guiding member/treatment head showing how an orifice of an injector is situated such as to engage the passing thread for injecting treatment-material thereover, according to some embodiments of the invention.
Figure 5B:
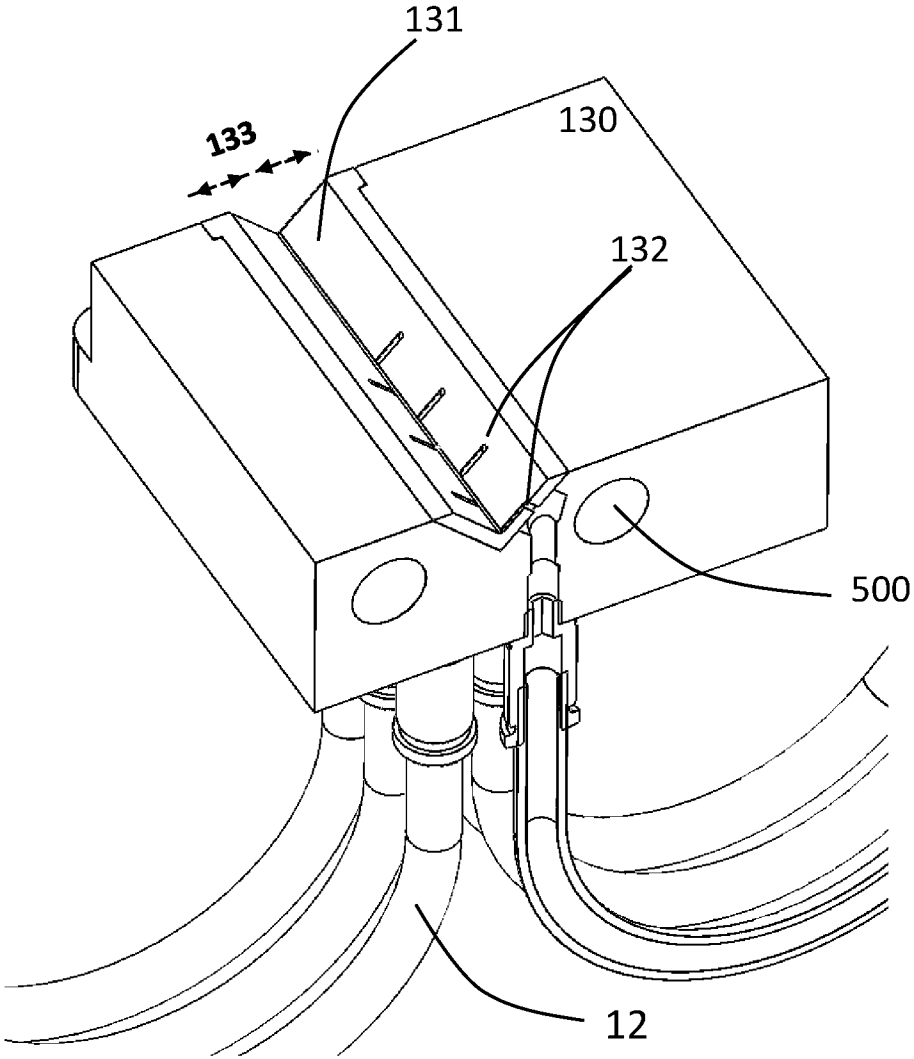

FIGS. 5A-5B describe one embodiment of the treatment head 130 according to the invention. The dispensed treatment-material flows from the treatment cartridge through a dedicated hose/tube 12 to reach the channels/orifices 132 in the treatment head body 130. In a specific embodiment, and as illustrated in the figure, the treatment head 130 may comprise a heating component/element 500 operated to keep a certain temperature of said treatment head 130 that is required in order to worm the treatment-material and/or passing thread to a working temperature. The heated treatment-material is then injected onto the thread 90 via said orifices 132.

It should be noted that although FIGS. 4 and 5 illustrate 4 and 6 tubes 12, respectively, the number of tubes, corresponding to the number of injector sets 110, may vary from one to any number according to user's needs, such as 3, 4, 5, 6, 7, 8, 9, 10 or more. In specific embodiments, the treatment head comprises more orifices than injectors, in which case each injector may be connected to several orifices and the amount, timing, and exit orifice for applying each treatment material from each injector, is controlled by the thread treatment machine according to the received TRP.

In some embodiments, the treatment machine 100 further includes a mechanism for adapting the width 133 of the conduit 131 to the thread type and thickness being used.

Figure 5C:
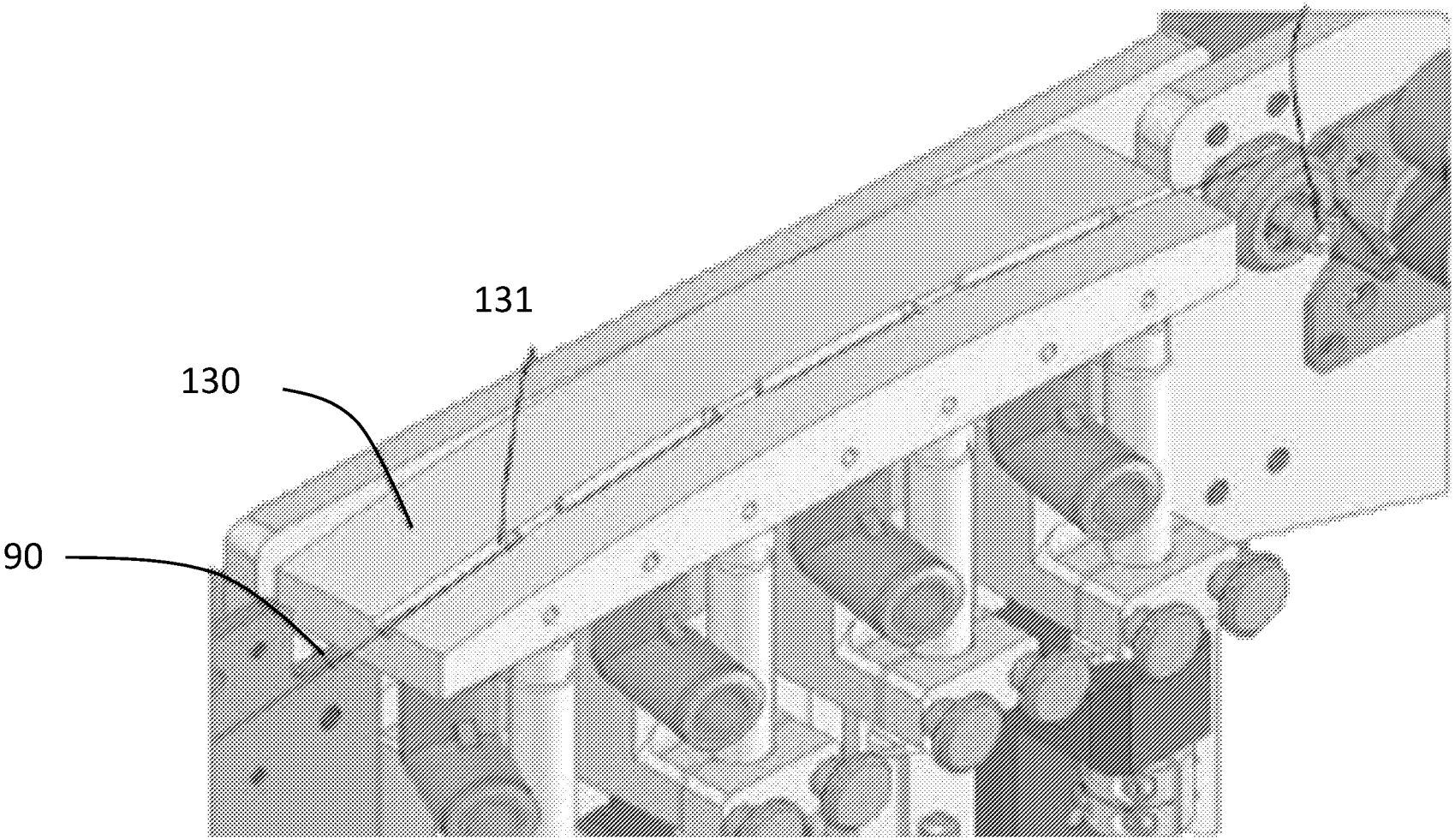

FIG. 5C is a zoom-in view of a part of the thread treatment machine showing a treatment head/guiding member 130 of the machine configured for guiding a thread 90 over orifices of the syringe treatment materials injectors through a conduit thereof. The treatment head/guiding member 130 is connected and located over the needles of the injectors and has a guiding conduit 131, which is configured as an open channel, for directing the thread 90 therein. In specific embodiments, said guiding conduit further comprises a cover, and is thus configured as a tunnel-channel. The guiding conduit 131 has holes 132 thereover located over the needles orifices to allow the treatment material to pass therethrough upwardly onto the passing thread 90. The conduit 131 channel-like design enables both directing the thread 90 over the orifices as well as collecting excess injected treatment material therein. In some embodiments, the guiding conduit 131 allows cleaning of treatment material therefrom and/or from the orifices. In some embodiments, the thread treatment machine 100 further includes a mechanism for adapting the width 133 of the guiding conduit 131 to the thread type and thickness being used.

Figure 6:
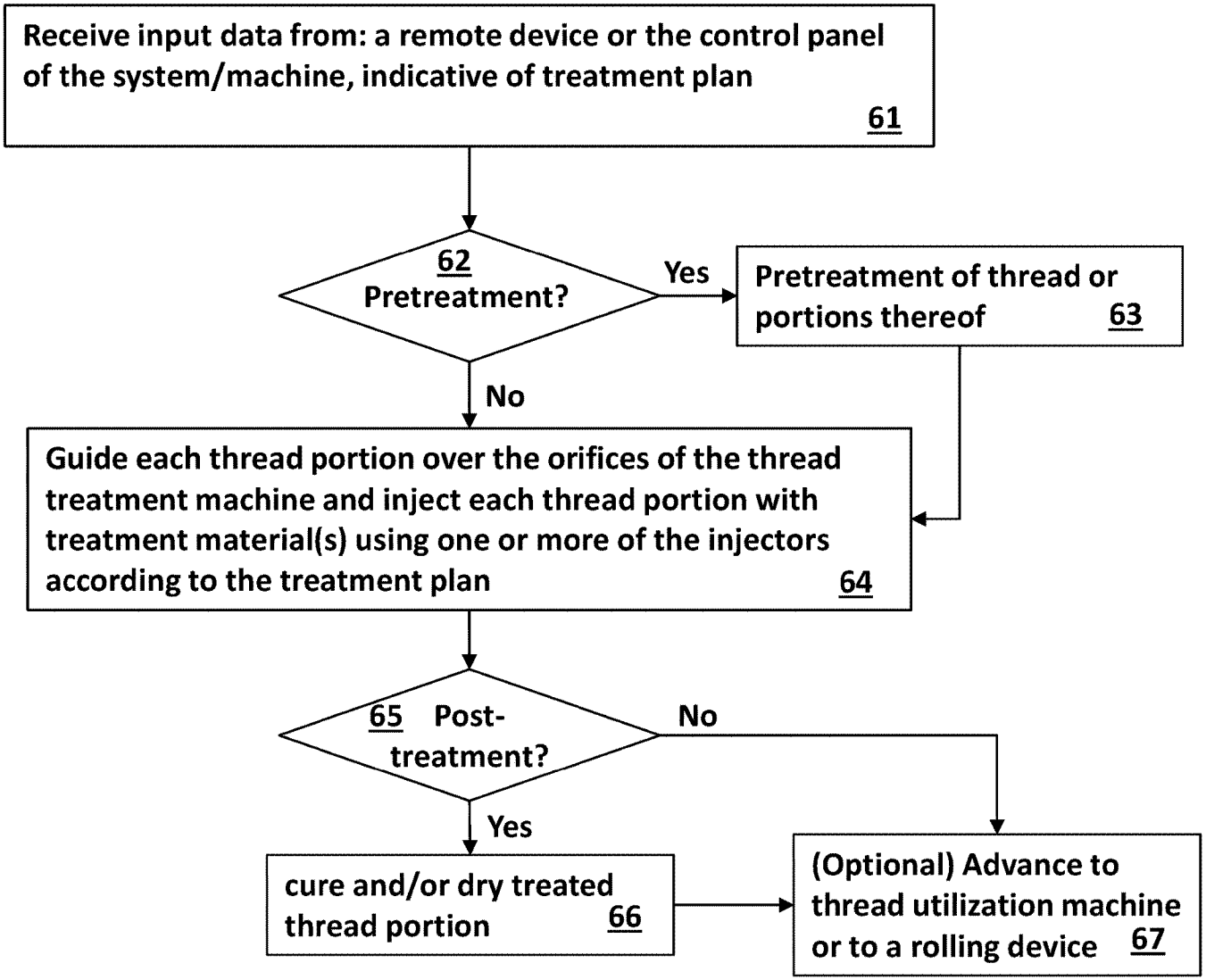
FIG. 6 is a flowchart, schematically illustrating a process for treating a thread using the thread treatment machine, according to some embodiments of the invention.

Reference is now made to FIG. 6, showing a flowchart of a process for treating thread portions using the thread treatment machine and system according to some embodiments of the invention. The thread treatment machine or a device communicating therewith receives input data, which includes a treatment plan data, optionally from a remote device via a designated application 61. The received treatment plan contains therein readable commands for the thread treatment machine indicative of how the machine is to be controlled and operated to achieve the desired treatment effect. If the treatment plan requires a pretreatment process 62, the machine will automatically operate devices/units designed for pretreatment of the thread 63 such as moistening, drying, curing, optically or chemically treating the thread by directing the thread through the pretreatment devices/units while operating these devices prior to directing the thread over the orifices for treating thereof. If no pretreatment is required or the pretreatment stage is done, the pretreated or untreated thread is advanced through and over orifices of the injectors 64 for injecting thereover treatment-materials from the cartridges according to the treatment plan data. The treatment/dyeing process in the process according to the invention is a tension-controlled process, i.e. the thread is kept at a pre-defined desired tension necessary for smooth and optimum operation of the thread treatment machine and optimal treatment/dyeing properties, as well as of the pre- or post-treatment process if applicable. The treatment/dyeing process in the process according to the invention is also a temperature-controlled process, i.e. the thread and/or the treatment material(s) are kept at a pre-defined temperature profile necessary for optimal thread treatment/dyeing, as well as of the pre- or post-treatment process if applicable.

If the treatment plan requires a post-treatment process 65, the thread is directed over or between post-treatment devices/units 444 such as through a curing and/or drying (heating) device 66 and/or binder and/or lubrication unit, while the machine operates these devices according to the treatment plan data. If no post-treatment is required or after the post-treatment is concluded, the thread is optionally advanced to another machine for utilizing thereof such as a sewing machine and the like, or rolled into a thread roll, or packed in any other manner by an external packing or rolling device or by a packing or rolling device embedded in the thread treatment machine for later use.

Figure 7:
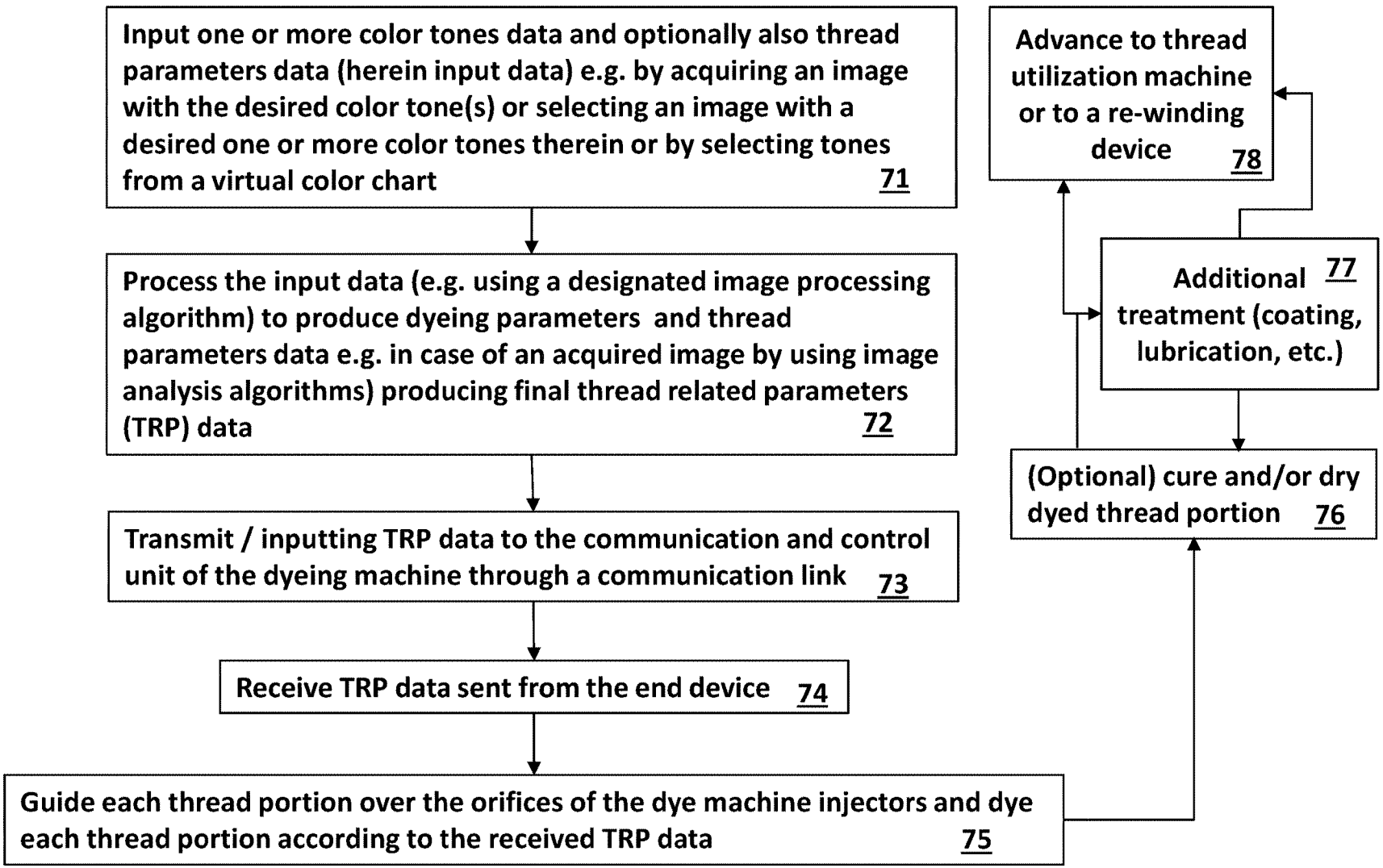
FIG. 7 is a flowchart illustrating a process of dyeing a thread according to a dyeing treatment plan achieved from data acquired and/or inputted by a user through a designated application module operable through the user end device, using a calibration color chart, according to some embodiments of the invention.

Reference is now made to FIG. 7 showing a flowchart illustrating a method or process of dyeing threads in color tones that correspond to data achieved inter alia via a photograph image sent, e.g., by a user through a user end device, according to some embodiments of the invention. The method steps are achieved by using a system of the present invention, such as the one described in reference to FIG. 1 having dye treatment-materials in its injector sets' cartridges.

The user may use his/her end device for inputting dyeing parameters data indicative of the desired one or more color tones for dyeing of the thread or portions thereof and optionally also thread parameters data 71 indicative for example, of the length of the thread one or more portions to be dyed in each desired color. The application GUI may be designed such as to allow inputting the dyeing parameters data through one or more of the following options: (i) by acquiring an image using image acquiring means, e.g. of the end device (e.g. camera), where the image contains therein the one or more desired colors for the dyeing and also a color chart photographed under the same photography illumination and shading conditions (preferably together) for using an image analysis algorithm of the application for identifying the desired color tone (e.g. code of one or more of the colors in the colors chart indicative of each desired color tones); and/or (ii) by selecting one or more color tones from a virtual color chart provided by the application GUI. In some embodiments, the GUI is designed to allow the user to acquire the image along with the colors chart and then display the image with GUI tools that allow the user to select the area in the image having the desired color tone therein (e.g. by using a movable virtual marker over the image display).

The application GUI may also allow the user to select thread type, thread basic color, thread portion length to be dyed for each color and other features such as selecting the colors order along the thread for a selection of more than one color tone for dyeing etc.

Once all parameters are inputted, the application is configured to process the data to create a data file thereof indicative of all treatment related parameters (TRP) required for dyeing the thread or portions thereof 72 and transmit this TRP data to the communication and control unit of the dyeing machine 73, e.g. via wireless cellular communication link.

This data is then received at the control and communication unit of the dyeing machine 74 and the thread or portion thereof is guided over the orifices at the treatment head and dyed according to the received data 75. In some embodiments, the communication and control unit processes the received TRP data to adapt the received input data to the particular machine settings and to the particular thread type it uses and optionally also to the particular dyes it uses.

Each thread portion that is passed through the injectors of the thread dyeing machine and dyed can then be dried or cured via curing or drying means of the dyeing machine 76.

After the initial curing and before forwarding the treated thread to the final destination 78, e.g. a utilization machine or a re-winding device, the treated thread may undergo one or more additional treatment steps 77, which may require an additional curing step.

According to other embodiments of the invention, each cartridge in the thread treatment machine is integrated with a respective injector e.g. by having a head and a body having a piston therein for injecting the dye or treatment-material therein, such that the cartridge head comprises an opening for injecting the treatment material therefrom. The cartridge head may have a groove thereover for receiving a passing thread portion therein.

According to some embodiments of the invention, the thread treatment machine may be additionally or alternatively designed for coating threads such as films or wires for enhancing or adding properties thereto. For example the machine can be used for coating electric wires with isolating polymeric materials for communication and/or electric cabling utilization or for coating filaments with electrically conductive materials, e.g. for printed boards construction industry designing each thread portion coating according to the specific board requirements.

The thread treatment machine of the invention can also be used for treating surgery threads with medical materials such as nutraceuticals and/or pharmaceuticals for surgical suture, as mentioned above. In this example, the thread treatment machine may be stationed in a surgery compound or room for serving one or more surgery rooms for treating the same surgery thread or several types thereof according to the specific surgery or surgery type to be performed. The application, for this utilization of the machine, may be adapted such as to allow users to input parameters such as one or more of: thread type and length required for the surgery, medical treatment-materials and quantities thereof for creating a treatment plan that is suited for the specific surgery. The application or machine may include therein and/or enable saving treatment plans that were already defined for specific surgeries for reusing thereof for the same surgery types and similar patients' conditions.

According to some embodiments of the invention, the TRP of the treatment plan also include "overlapping data" allowing controlling the areas between two adjacent portions of the thread that are treated with different treatment-materials mixture or quantities. The overlapping data comprises at least one of: thread pretreatment related parameters; injection controlling parameters, which allow controlling the overlapping properties such as causing or preventing spotting and controlling the overlapping spot area.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A thread treatment machine for treating a thread or portions thereof, said thread treatment machine comprising:
   a) a plurality of cartridges containing a same or different thread treatment-materials therein;
   b) at least one treatment-material delivery unit/system, configured to connect to each one of the plurality of cartridges, and configured for delivering/applying said treatment-material from its respective cartridge over a passing portion of the thread;
   c) a microfluidic mixer in which said treatment-material (s) mix prior to theft delivery to the passing portion of the thread;
   d) a treatment head with a guiding conduit configured for guiding the thread and applying said treatment-material (s) thereon as it passes through via one or more dedicated orifices;
   e) at least one engine for pulling said thread through said thread treatment machine;
   f) at least one thread-tension creating and/or controlling unit;
   g) a communication and control unit for receiving treatment plan data indicative of at least one machine readable treatment related parameters (TRP) associated with at least one treatment effect for each thread portion to be treated, at least for controlling quantities of treatment-material outputted by each one of the at least one treatment-material delivery unit/system at each given timeframe for controlling the treatment effect of each of the passing portions of the thread, according to the received treatment plan data; and
   h) at least one treatment-material fixation/drying unit/system (post treatment), comprising at least one of: UV-based radiating system, heating system, and pressure system.

2. The thread treatment machine according to claim 1, wherein each of the at least one treatment-material delivery unit/system comprises: (i) an injector and drive means comprising a motor for operating injection of said injector, and an actuator displaceable by said motor, said actuator being configured for displacing a piston member of said injector for injecting treatment-material therefrom; or (ii) a peristaltic pump or a pressurizing pump.

3. The thread treatment machine according to claim 1, comprising two parallel routes for each of the treatment materials: one leading directly from the respective cartridge to the treatment head; and the other passing through said microfluidic mixer, wherein the thread treatment machine further comprises a valve that directs each of the treatment materials to an appropriate route according to the received treatment plan data.

4. The thread treatment machine according to claim 1, further comprising at least one of:
   i) one, two, three, four or more thread-tension creating and/or controlling units;
   ii) a heating unit for adjusting the temperature of the treatment-material prior to its application onto the thread;
   iii) a thread-guiding set configured for directing the thread over the one or more orifices within said treatment head and through the thread treatment machine;
   and
   v) a vacuum/low-pressure generating system for reducing the pressure at the treatment head below ambient pressure, and/or air flow (in or out) system for blowing air in or out of the head and/or drying system.

5. The thread treatment machine according to claim 1, wherein said one or more orifices within said treatment head are positioned either below the thread as it passes through, thereby allowing upwardly delivery of the treatment-material(s), opposite to gravitation, or above the thread as it passes through, thereby allowing downwardly delivery of the treatment-material according to gravitation.

6. The thread treatment machine according to claim 1, wherein the thread treatment machine comprises two or more orifices, and the distance between the orifices is adjustable, and/or the dimensions of each orifice is adjustable in order to prevent or at least reduce effects of drawing or pulling excess treatment-material by the thread, depending on natural saturation of the thread and capillary action of the orifice.

7. The thread treatment machine according to claim 1, wherein each one of the at least one treatment-material delivery unit/system is connectable to a respective cartridge containing a same or different thread treatment-material, such that the at least one treatment effect, set at the treatment plan data, is achieved by controlling a quantity of treatment-material injected from each of the respective cartridges, directly or indirectly: (i) over the passing portions of the thread; or (ii) into said microfluidic mixer and from there over the passing portions of the thread.

8. The thread treatment machine according to claim 1 further comprising:
   a) at least one pretreatment unit/system for pretreatment of the thread prior to delivery of the treatment-material thereto; and/or
   b) at least one post-treatment unit for post treating the thread after the delivery of the treatment-material thereto.

9. The thread treatment machine according to claim 1,
   wherein said treatment-material is a dye for coloring the thread, and said communication and control unit is adapted to: (i) control timing of applying the dye from each one of the plurality of cartridges, or (ii) control mixing of the dye within the microfluidic mixer and the timing of applying the dye therefrom, both according to: a desired color tone for a respective thread portion passing through; thread characteristics; a moving pace of a thread portion; and spacing between the orifices at the treatment head.

10. The thread treatment machine according to claim 9 further comprising a color identification unit for identifying the resultant color, and wherein said communication and control unit is adapted to compare the resultant color tone with the desired color tone and adjust a mixing of the dye within the microfluidic mixer and/or the timing of applying the dye from each cartridge, until reaching the desired color tone.

11. The thread treatment machine according to claim 1, wherein one of said plurality of cartridges and one of said at least one treatment-material delivery unit/system that is associated therewith, constitute a single unit, wherein said single unit further comprises an injector body and a nozzle/tube associated with an orifice/hole at the treatment head or with the microfluidic mixer.

12. The thread treatment machine according to claim 11, wherein the single unit is replaceable.

13. The thread treatment machine according to claim 4, wherein the thread-guiding set comprises a mechanism for adapting the width of the guiding conduit within said treatment head, adapted according to the thread type and thickness being used.

14. The thread treatment machine according to claim 5, wherein said one or more orifices within said treatment head are positioned are positioned below or above the thread as it passes through, without creating a direct contact between said one or more orifices and said thread.

15. The thread treatment machine according to claim 6, wherein or the dimensions of each orifice is independent from one another.

16. The thread treatment machine according to claim 7, wherein the treatment plan data is received from a remote end device.

17. A system for treating threads or portions thereof, said system comprising:

a) a thread treatment machine as defined in claim 1;

b) an application module, optionally operable via a user end device, having a user interface, said application module being configured for: (i) inputting treatment related plan data associated with at least one desired treatment effect for a thread portion treatment, (ii) setting a machine readable treatment plan comprising treatment related parameters (TRP) data based thereon, and (iii) transmitting said treatment plan data to said thread treatment machine over at least one communication link; and c) a vacuum/low-pressure generating system for reducing the pressure at the treatment head below ambient pressure, and/or air flow (in or out) system for blowing air in or out of the head and/or drying system.

18. The system according to claim 17, wherein said thread treatment is dyeing, and said application module uses image acquiring means for having the user acquire an image of the desired color tone for thread dyeing and a colors chart, said application module being configured for operating an image processing algorithm for identifying the desired at least one color tone from the acquired image, wherein:

said user interface optionally provides: (i) graphical tools for displaying the acquired image and for enabling the user to select at least one area in the acquired image in which the desired color tone is displayed; and/or (ii) selection tools enabling the user to select a desired color tone from a predefined chart of colors displayed for selection using a display means;

said TRP comprise data defining thread parameters, indicating all data required for the thread treatment system to operate such as to produce the required treatment effect or required to calculate the treatment materials quantities and selection; and/or said treatment-material is: dye material, coating material, dye effect material, conductive materials, magnetic material, biological active material, or chemical treatment-material.

19. A method for treating threads comprising the steps of:

a) providing a thread treatment machine according to claim 1 being configured for injecting a treatment-material over a passing thread portion for treating thereof, and controllable by said communication and control unit;

b) providing an application module, optionally operable via a users' end device, having a user interface, said application module being configured for inputting treatment plan data associated with desired treatment effect(s), determining treatment related parameters (TRP) for setting a machine readable treatment plan data based thereon, and transmitting said treatment plan data to said thread treatment machine;

c) receiving the treatment plan data;

d) directing a thread through a guided path over the treatment head of said thread treatment machine, optionally by using a guiding means; and e) applying at least one treatment-material from said cartridge(s) over at least one thread portion of the guided thread according to the received treatment plan data, wherein step (e) is optionally carried out while generating vacuum/low-pressure for reducing the pressure at the treatment head below ambient pressure, and/or air flow (in or out) system for blowing air in or out of the head and/or drying system, thus facilitating faster employment of the treatment-material and fixation thereof, and wherein said TRP comprise data defining thread parameters, indicating all data required for the thread treatment machine to operate such as to produce the required treatment effect or required to calculate the treatment materials quantities and selection, thereby obtaining a treated thread.

20. The method according to claim 19, wherein said treatment is dyeing and said TRP data comprises the color tone treatment effect for each thread portion to be treated, at least for controlling quantities of treatment-material outputted by each treatment-material delivery unit/system at each given timeframe for controlling the treatment effect of each passing thread portion, according to the received treatment plan data.

21. The method according to claim 20, wherein said application module uses image acquiring means for having the user acquire an image of the desired color tone for thread dyeing and a colors chart, said application module further being configured for operating an image processing algorithm for identifying the desired at least one color tone from the acquired image.

22. The method according to claim 20, wherein said user interface provides: (i) graphical tools for displaying the acquired image and for enabling the user to select at least one area in the acquired image in which the desired color tone is displayed; and/or (ii) selection tools enabling the user to select a desired color tone from a predefined chart of colors displayed for selection using a display means.

23. The method according to claim 21 further comprising a step of identifying the resultant color, wherein said identification of said resultant color is optionally carried out directly on the dyed thread.

24. The method according to claim 23, wherein said thread treatment machine comprises a microfluidic mixer, and said identification of said resultant color is carried out on the color mixture within said microfluidic mixer prior to its delivery to the thread.

25. The method according to claim 23, further comprising a step of comparing the resultant color tone with the desired inputted color tone and adjusting the mixing of the dye within the microfluidic mixer if present, and/or the timing of applying the dye from each cartridge, until reaching the desired color tone.

* * * * *